US009328552B2

(12) United States Patent
Dann et al.

(10) Patent No.: US 9,328,552 B2
(45) **Date of Patent: *May 3, 2016**

(54) DUAL FABRIC COVERING FOR ARCHITECTURAL OPENINGS

(75) Inventors: Kevin M. Dann, Englewood, CO (US); Michael J. Siebenaller, Broomfield, CO (US); Gary A. Marino, Denver, CO (US); Joseph E. Kovach, Brighton, CO (US)

(73) Assignee: Hunter Douglas Inc., Pearl River, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/609,665

(22) Filed: Sep. 11, 2012

(65) Prior Publication Data

US 2013/0000854 A1 Jan. 3, 2013

Related U.S. Application Data

(63) Continuation of application No. 12/429,432, filed on Apr. 24, 2009, now Pat. No. 8,261,807.

(60) Provisional application No. 61/048,271, filed on Apr. 28, 2008.

(51) Int. Cl.
*E06B 9/24* (2006.01)
*E06B 9/262* (2006.01)

(52) U.S. Cl.
CPC ..... *E06B 9/24* (2013.01); *E06B 2009/2458* (2013.01); *E06B 2009/2627* (2013.01)

(58) Field of Classification Search
CPC ..... E06B 9/24
USPC ..... 160/84.05, 84.01, 89, 120, 121.1, 127
See application file for complete search history.

(56) References Cited

U.S. PATENT DOCUMENTS 675,955 A 6/1901 Kinnear
1,958,695 A 5/1934 Claus (Continued)

FOREIGN PATENT DOCUMENTS

CA 2136941 A1 5/1996
EP 0455911 A1 11/1991

(Continued)

OTHER PUBLICATIONS

Author Unknown, "⅜" Double Cell Light Filtering Shades," http://www.justblinds.com/dynamic/product.cfm?productID=2, 2 pages, (Mar. 14, 2006).

(Continued)

*Primary Examiner* — Katherine Mitchell
*Assistant Examiner* — Marcus Menezes
(74) *Attorney, Agent, or Firm* — Dorsey & Whitney LLP

(57) ABSTRACT

A covering for an architectural opening with improved insulating properties in one embodiment includes face-to-face cellular insulative components defining a fabric with dual layers of cells with the fabric being retractably mounted in a headrail so as to either be rolled about a roller or gathered adjacent to the bottom of the headrail. A first component of the fabric includes a pair of spaced parallel sheets of material interconnected with horizontally-extending flexible vanes so as to define a plurality of horizontally-extending, vertically adjacent cells of generally rectangular cross-sectional configuration. A second component of the fabric is mounted on one sheet of the first component of the fabric so as to form a plurality of vertically adjacent drooping segments of fabric forming a roman-shade appearance. Single or multiple layers of the components can be used with or without the other type of component.

35 Claims, 17 Drawing Sheets

(56) References Cited

U.S. PATENT DOCUMENTS

| | | | | |
|---|---|---|---|---|
| 2,140,049 | A | 12/1938 | Grauel | |
| 2,267,869 | A | 12/1941 | Loehr | |
| RE22,311 | E | 5/1943 | Roy | |
| 2,350,200 | A | 5/1944 | Starr | |
| 2,874,612 | A | 2/1959 | Luboshez | |
| 3,190,086 | A | 6/1965 | Klein | |
| 3,222,689 | A | 12/1965 | Efron et al. | |
| D208,350 | S | 8/1967 | Cheris | |
| 3,487,875 | A * | 1/1970 | Harman et al. | 160/84.01 |
| 3,566,499 | A | 3/1971 | James | |
| 4,039,019 | A | 8/1977 | Hopper | |
| 4,194,550 | A | 3/1980 | Hopper | |
| 4,282,919 | A | 8/1981 | Teno | |
| 4,307,768 | A | 12/1981 | Anderson | |
| 4,388,354 | A | 6/1983 | Suominen | |
| 4,625,786 | A | 12/1986 | Carter et al. | |
| 4,846,243 | A * | 7/1989 | Schneider | 160/84.02 |
| 4,921,032 | A | 5/1990 | May | |
| 5,097,884 | A | 3/1992 | Sevcik et al. | |
| 5,104,469 | A | 4/1992 | Colson | |
| 5,129,440 | A * | 7/1992 | Colson | 160/84.02 |
| 5,205,334 | A | 4/1993 | Judkins | |
| 5,228,936 | A | 7/1993 | Goodhue | |
| 5,231,708 | A | 8/1993 | Hansen | |
| 5,313,999 | A | 5/1994 | Colson et al. | |
| 5,339,883 | A | 8/1994 | Colson et al. | |
| 5,355,555 | A | 10/1994 | Zarelius | |
| 5,419,385 | A * | 5/1995 | Vogel et al. | 160/121.1 |
| 5,490,553 | A | 2/1996 | Colson et al. | |
| 5,503,210 | A | 4/1996 | Colson et al. | |
| 5,525,395 | A | 6/1996 | Huang | |
| 5,547,006 | A | 8/1996 | Auger | |
| 5,558,925 | A | 9/1996 | Fritzman | |
| 5,645,504 | A | 7/1997 | Westhoff | |
| 5,649,583 | A | 7/1997 | Hsu | |
| 5,680,891 | A | 10/1997 | Prince | |
| 5,701,940 | A | 12/1997 | Ford et al. | |
| 5,714,034 | A | 2/1998 | Goodhue | |
| 5,733,632 | A | 3/1998 | Marusak | |
| 5,746,266 | A * | 5/1998 | Colson et al. | 160/84.05 |
| 5,787,951 | A | 8/1998 | Tonomura et al. | |
| 5,855,235 | A | 1/1999 | Colson et al. | |
| 5,897,731 | A | 4/1999 | Colson et al. | |
| 5,918,655 | A | 7/1999 | Corey | |
| 5,960,847 | A | 10/1999 | Crider et al. | |
| 6,006,812 | A | 12/1999 | Corey | |
| 6,112,797 | A | 9/2000 | Colson et al. | |
| 6,129,131 | A | 10/2000 | Colson | |
| 6,164,363 | A | 12/2000 | Colson et al. | |
| 6,223,802 | B1 | 5/2001 | Colson | |
| D443,455 | S | 6/2001 | Hynniman | |
| 6,289,964 | B1 | 9/2001 | Colson et al. | |
| 6,345,486 | B1 | 2/2002 | Colson et al. | |
| 6,354,353 | B1 * | 3/2002 | Green et al. | 160/84.04 |
| 6,377,384 | B2 | 4/2002 | Corey et al. | |
| 6,484,786 | B1 | 11/2002 | Ruggles et al. | |
| D468,950 | S | 1/2003 | Judkins | |
| 6,572,725 | B2 | 6/2003 | Goodhue | |
| 6,595,262 | B2 | 7/2003 | Chen | |
| 6,688,373 | B2 | 2/2004 | Corey et al. | |
| 6,740,389 | B2 | 5/2004 | Yu | |
| 6,767,615 | B1 | 7/2004 | Judkins et al. | |
| 6,772,815 | B1 | 8/2004 | Judkins | |
| 6,792,994 | B2 | 9/2004 | Lin | |
| 6,932,138 | B2 | 8/2005 | Yu et al. | |
| 6,978,821 | B2 | 12/2005 | Welfonder | |
| D515,345 | S | 2/2006 | Herhold et al. | |
| 7,111,659 | B2 | 9/2006 | Harper et al. | |
| 7,117,917 | B2 | 10/2006 | Allsopp | |
| 7,124,802 | B2 * | 10/2006 | Sudano | 160/89 |
| 7,147,029 | B2 | 12/2006 | Kovach et al. | |
| 7,159,634 | B1 * | 1/2007 | Judkins | 160/84.05 |
| 7,191,816 | B2 * | 3/2007 | Colson et al. | 160/84.05 |
| 7,207,370 | B2 | 4/2007 | Snyder et al. | |
| 7,237,591 | B2 | 7/2007 | Snyder et al. | |
| 7,311,131 | B2 | 12/2007 | Nien et al. | |
| 7,337,822 | B2 | 3/2008 | Snyder et al. | |
| D568,082 | S | 5/2008 | Bohlen | |
| 7,404,428 | B2 | 7/2008 | Sun et al. | |
| 7,500,505 | B2 | 3/2009 | Smith et al. | |
| 7,549,455 | B2 | 6/2009 | Harper et al. | |
| 7,578,334 | B2 | 8/2009 | Smith et al. | |
| 7,588,068 | B2 | 9/2009 | Colson et al. | |
| 7,617,859 | B2 | 11/2009 | Auger | |
| D605,885 | S | 12/2009 | Judkins | |
| 7,637,301 | B2 | 12/2009 | Forst | |
| 7,708,047 | B2 | 5/2010 | Auger | |
| 7,730,931 | B2 | 6/2010 | Stern | |
| D622,964 | S | 9/2010 | Colson | |
| D623,419 | S | 9/2010 | Swiszcz et al. | |
| D632,492 | S | 2/2011 | Colson et al. | |
| D632,493 | S | 2/2011 | Colson et al. | |
| D640,472 | S | 6/2011 | Colson et al. | |
| D640,875 | S | 7/2011 | Colson et al. | |
| 7,971,624 | B2 | 7/2011 | Harper et al. | |
| 8,151,857 | B2 | 4/2012 | Colson et al. | |
| 8,171,640 | B2 | 5/2012 | Colson et al. | |
| 8,261,807 | B2 | 9/2012 | Dann et al. | |
| 8,393,080 | B2 | 3/2013 | Ballard, Jr. et al. | |
| 8,496,768 | B2 | 7/2013 | Holt et al. | |
| 8,607,838 | B2 | 12/2013 | Colson et al. | |
| 2004/0074611 | A1 | 4/2004 | Colson et al. | |
| 2004/0079492 | A1 * | 4/2004 | Lin | E06B 9/262 160/84.01 |
| 2004/0231805 | A1 | 11/2004 | Sudano | |
| 2005/0087309 | A1 | 4/2005 | Nien et al. | |
| 2005/0109467 | A1 | 5/2005 | Huang | |
| 2005/0155722 | A1 | 7/2005 | Colson et al. | |
| 2006/0048659 | A1 | 3/2006 | Colson et al. | |
| 2006/0151126 | A1 * | 7/2006 | Lampe | 160/84.01 |
| 2006/0157205 | A1 * | 7/2006 | Auger | 160/84.05 |
| 2007/0000618 | A1 * | 1/2007 | Ng et al. | 160/84.01 |
| 2007/0010147 | A1 | 1/2007 | Swiszcz | |
| 2007/0074826 | A1 | 4/2007 | Jelic et al. | |
| 2007/0246170 | A1 | 10/2007 | Marzilli | |
| 2007/0251652 | A1 | 11/2007 | Anthony et al. | |
| 2008/0173409 | A1 | 7/2008 | Robertson et al. | |
| 2013/0139977 | A1 | 6/2013 | Ballard et al. | |
| 2014/0096915 | A1 | 4/2014 | Colson et al. | |

FOREIGN PATENT DOCUMENTS

| | | | |
|---|---|---|---|
| EP | 0482794 | A1 | 4/1992 |
| EP | 0654577 | A1 | 5/1995 |
| EP | 1213435 | A2 | 6/2002 |
| EP | 1347148 | A2 | 9/2003 |
| GB | 1494842 | A | 12/1977 |
| GB | 1586801 | A | 3/1981 |
| JP | 6-173549 | | 6/1994 |
| JP | 7039449 | A | 2/1995 |
| JP | 9-221969 | | 8/1997 |
| KR | 1019930013412 | | 7/1993 |
| KR | 1020050064489 | | 6/2005 |
| KR | 1020060127009 | | 12/2006 |
| TW | 549344 | | 8/2003 |
| WO | 85/02760 | A1 | 7/1985 |
| WO | 94/29559 | A1 | 12/1994 |
| WO | 2005019584 | A2 | 3/2005 |
| WO | WO 2005062875 | A2 * | 7/2005 |
| WO | 2005081948 | A2 | 9/2005 |
| WO | 2006023751 | A2 | 3/2006 |
| WO | 2006098853 | A2 | 9/2006 |

OTHER PUBLICATIONS

Author Unknown, "Compare Rvalue Among Window Treatment Products," http://symphonyshades.com/rvaluecomparison.html, 1 page, (Oct. 16, 2007).

* cited by examiner

| FABRIC STRUCTURE | | |
|---|---|---|
| TYPE 1 |  | *LOOPED FACE* |
| TYPE 2 |  | *SINGLE CELL* |
| TYPE 3 |  | *DOUBLE CELL* |
| TYPE 4 |  | *SINGLE CELL WITH LOOPED FACE* |

| AIR PERMEABILITY OF CELL STRUCTURE MATERIALS | |
|---|---|
| *KNIT* | *HIGH* |
| *WOVEN* | *LOW* |
| *METALIZED FLIM* | *NONE* |

| *TYPE* | KNIT | WOVEN | METALIZED FILM |
|---|---|---|---|
| 1 | R=+1 | R=+2 | R=+2 |
| 1 | R=+1 | R=+2 | R=+3 |
| 3 | R=+1.5 | R=+3 | R=+5 |
| 4 | R=+1.5 | R=+2.5 | R=+3.5 |

DUAL FABRIC COVERING FOR ARCHITECTURAL OPENINGS

CROSS REFERENCE TO RELATED APPLICATIONS

The present application is a continuation of co-pending U.S. patent application Ser. No. 12/429,432, ("the '432 application"), which was filed on Apr. 24, 2009, now U.S. Pat. No. 8,261,807, and entitled "Dual Fabric Covering For Architectural Openings", which claims the benefit under 35 U.S.C. §119(e) to U.S. provisional patent application No. 61/048,271, ("the '271 application"), which was filed on Apr. 28, 2008 and entitled "Dual Fabric Covering For Architectural Openings". The '432 and '271 applications are incorporated by reference into the present application in their entireties.

BACKGROUND OF THE INVENTION

1. Field of the Invention

The present invention relates generally to coverings for architectural openings and more specifically to a covering for an architectural opening that includes a fabric with single or multiple confronting insulating components providing cellular layers for improved insulation.

2. Description of the Relevant Art

Cellular coverings for architectural openings are a fairly recent innovation providing both attractive aesthetics as well as insulating properties. Cellular coverings for architectural openings come in a number of different arrangements. Some include horizontally disposed stacked hexagonal cells which are attached along their length to similar cells to define a fabric which is transversely collapsible. Such a fabric can be moved between an extended position covering an architectural opening and a retracted collapsed position adjacent to a headrail. Some such hexagonal cellular products include layers of cells and are commonly referred to as multiple cell coverings.

Other cellular products include a product wherein a pair of spaced sheets of sheer fabric or the like is interconnected by horizontally extending transversely spaced flexible vanes. By shifting the sheets vertically relative to each other, the vanes are caused to move between open and closed positions such that in an open position a cell is defined between the sheets and adjacent vanes and in a closed position the sheets are shifted into closely adjacent relationship with the vanes extending in a flat overlapping orientation therebetween.

Some other cellular products include roman shade type products where fabric is draped along horizontal lines so as to define vertically adjacent cells which provide a different aesthetic than the previously described cellular products.

Depending upon the type of cellular fabric, it can be moved between extended and retracted positions with different types of operating systems. One system includes a roller in a headrail around which the cellular fabric can be wrapped or unwrapped. Another system permits the fabric to be moved up and down with a bottom rail that is attached to lift cords so that by raising the lift cords and the bottom rail, the cellular fabric is gathered and can be neatly stacked adjacent to a headrail.

While known cellular products have varied aesthetics as mentioned above and also have superior insulating properties, energy costs have made it desirable to even further improve the insulating properties of such cellular products without sacrificing aesthetics.

It is to provide an improved retractable covering for architectural openings with enhanced insulating properties that the present invention has been developed.

SUMMARY OF THE INVENTION

The covering of the present invention utilizes a headrail to support a fabric where the fabric includes single or multiple cellular insulative components that are in confronting relationship thereby in some embodiments providing a multiple layer of cellular insulation to improve the insulating properties of the covering. In a first embodiment, one component of the fabric utilizes a pair of flexible sheets of material that are interconnected by vertically spaced, horizontally extending flexible vanes, which remain open when the sheets are in uniformly spaced parallel relationship as when the covering is extended, but when the sheets are moved in opposite vertical directions they allow the vanes to collapse so that the sheets are in closely adjacent relationship. While cellular fabric similar to that utilized in the present invention has been known in the art, the vanes are typically an inch or more in width so as to define a corresponding maximum spacing between the sheets. The vanes will typically overlap an adjacent vane when the sheets of material are moved into closely adjacent relationship with each other. In the present invention, the vanes themselves are very narrow and permit a maximum spacing between the sheets of less than an inch which has been found to enhance insulation.

A second component of the fabric in the first embodiment consists of a plurality of horizontally extending droops of fabric that are vertically adjacent to each other and secured to an outer face of one of the sheets used in the first component of the fabric. The drooped fabric provides a roman shade type appearance and in addition establishes another layer of cells within each droop of the material so that two layers of cells or air pockets are defined in the combined fabric to improve the insulating properties of the covering.

The drooped roman shade fabric is positioned to face the interior of a room in which the covering is mounted so that the first component of this covering is not readily visible from the interior of the building structure. The first component, however, faces outwardly of the building structure so as to give a fairly planar uniform appearance from outside the building structure.

The dual component cellular fabric of the first embodiment can be moved between extended and retracted positions by rolling it around a roller disposed in a headrail and from which the fabric is suspended or it can be gathered through use of a plurality of lift cords that are connected to a bottom rail and a pull cord so that the bottom rail can be raised or lowered to move the covering between retracted and extended positions, respectively.

In a second embodiment, the first component of the first embodiment is presented in a double layer and the second component is not used. It has also been found that the first component can be used alone and still improve insulation if the flexible vanes are properly sized.

Other aspects, features and details of the present invention can be more completely understood by reference to the following detailed description of preferred embodiments, taken in conjunction with the drawings and from the appended claims.

DETAILED DESCRIPTION OF THE INVENTION

Figure 1:
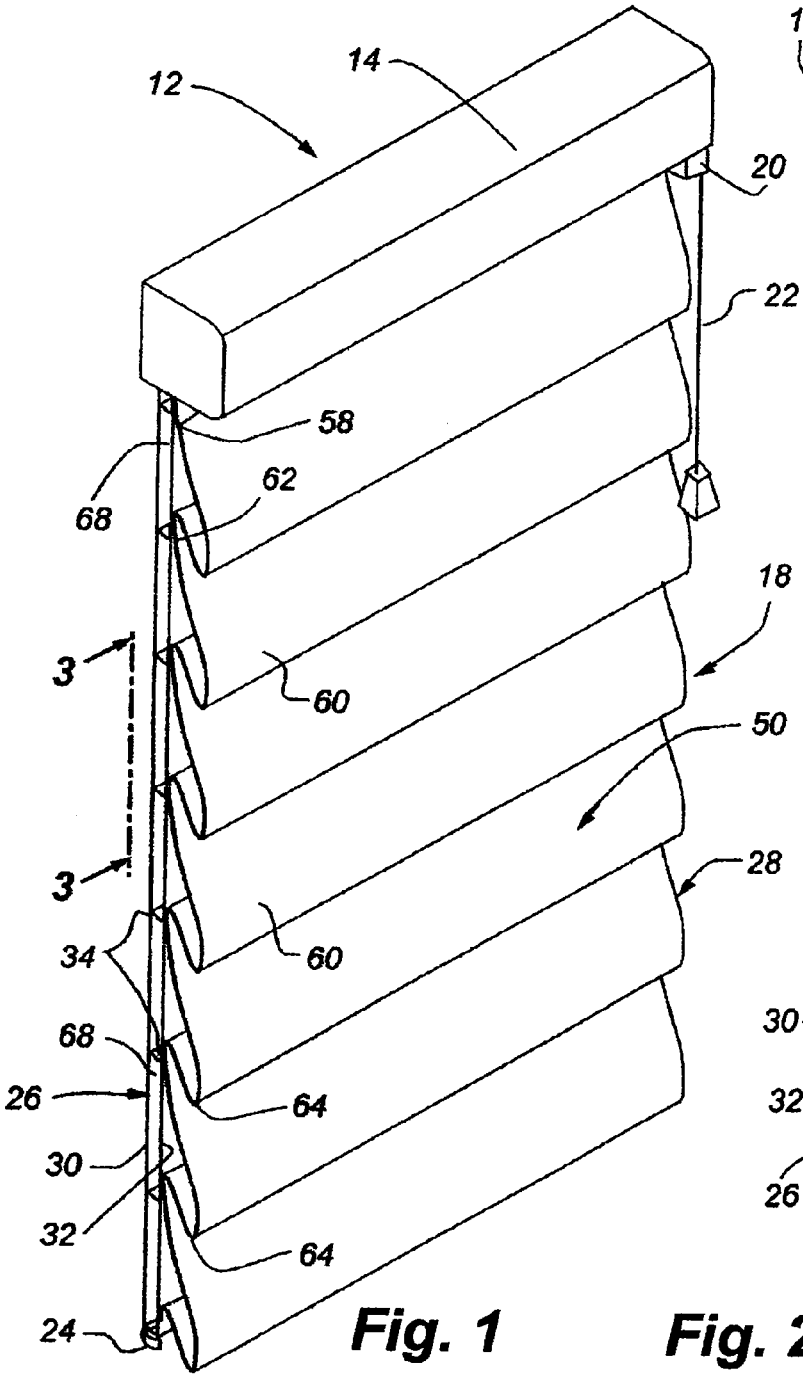
FIG. 1 is an isometric of a first embodiment of the covering of the present invention in a fully-extended position.

A first embodiment 12 of the covering of the present invention is shown in FIGS. 1-7. It will there be seen the covering includes a headrail 14 having a horizontally disposed and rotatable roller 16 about which a fabric 18 for the covering can be wrapped and unwrapped. Rotation of the roller is accomplished with a conventional pull cord control system 20 such that when a pull cord 22 is pulled downwardly the roller is rotated in a first direction to wrap the fabric therearound toward or into a retracted position. The control system includes a brake (not shown) that is engageable through manipulation of the pull cord so that the fabric can be stopped in any position between fully retracted and fully extended. By releasing the brake, the fabric unrolls from the roller through gravity achieved with use of a weighted bottom rail 24 secured along a bottom edge of the fabric. An example of a suitable control system is found in U.S. Pat. No. 6,129,131, which is of common ownership with the present application and hereby incorporated by reference.

The fabric 18 has first 26 and second 28 confronting cellular insulative components with the first cellular component having a rear sheet 30 and a front sheet 32 of flexible material, which might be made, for example, of a sheer material. The two sheets of material are interconnected with a plurality of horizontally extending and vertically spaced vanes 34. The vanes are made of a very flexible material and have an upper section 36 secured in face-to-face relationship with an inner face 38 of the front sheet 32 and a lower section 40 secured in face-to-face relationship with an inner face 42 of the rear sheet 30 at a level beneath the connection of the vanes to the front sheet. The connections between the vanes and the sheets can be achieved in any suitable manner such as with double-faced adhesive tape 44 as illustrated, lines of heat-sensitive adhesive, ultrasonic welding, or the like. Each vane can, therefore, be seen to include the upper horizontal section 36, an intermediate horizontal section 46, and the lower section 40 with living hinges 48 defined between each section of the vane. It will be appreciated that when the sheets 30 and 32 of material are shifted vertically in opposite directions, as can be seen for example in FIGS. 6 and 7, the vanes assume a fully open position as seen in FIG. 6 with the intermediate section substantially horizontally disposed and a closed position, as shown in FIG. 7, with the intermediate section vertically disposed when the sheets of material are moved into closely adjacent confronting relationship in a collapsed condition.

Figure 5:
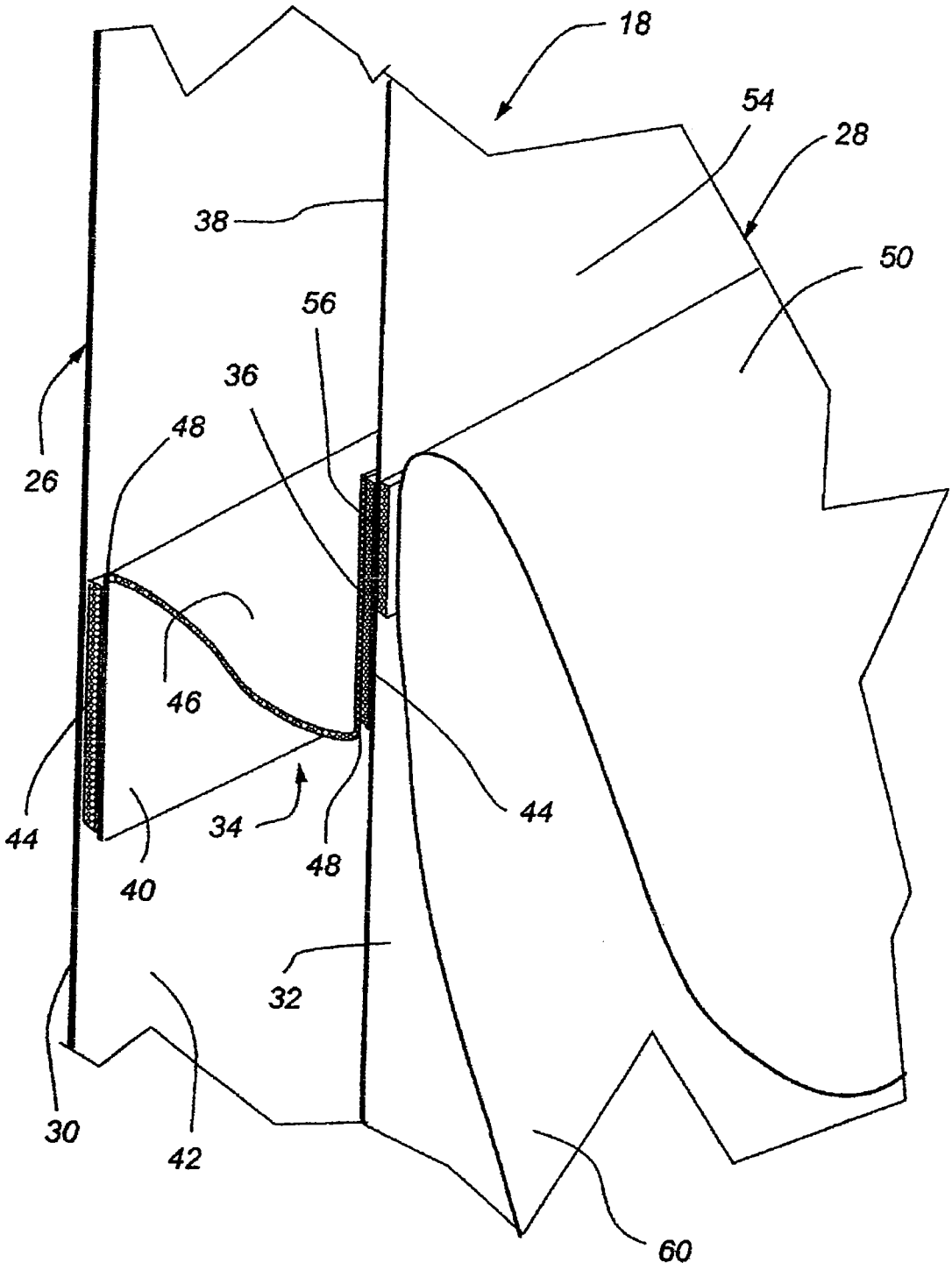
FIG. 5 is a further enlarged fragmentary section taken along line 5-5 of FIG. 3.

The second insulative component 28 of the fabric 18 consists of an elongated flexible material 50, which is secured near a top edge 52 to the outer face 54 of the front sheet 32 of material of the first component 26 as best seen, for example, in FIG. 5. The flexible material 50 is secured to the front sheet in any suitable manner which could, as illustrated, be with a strip of double-faced adhesive 56. The material is secured along a first horizontal line of attachment 58 (in alignment with the attachment of a horizontal section 36 to front sheet 32) so as to extend downwardly and define a droop 60 before extending upwardly and inwardly for attachment again to the front sheet along a second horizontal line of attachment 62 aligned with the next lower attachment of an upper section 36 with the front sheet 32. The horizontal lines of attachment do not have to be aligned with the attachments of upper section 36 to the front sheet 32 for functional reasons but has been found desirable for aesthetics. The length of material 50 between the lines of attachment is greater than the spacing between the lines of attachment so that the material is drooped forming a downwardly hanging fold 64 that overlies and conceals the lower line of attachment 62 as possibly seen best in FIG. 6. By securing the material 50 of the second insulative component 28 to the front sheet 32 of the first component 26 along a series of lines of attachment as described, a plurality of horizontally disposed droops 60 of fabric, which are vertically adjacent to each other, are established as seen for example in FIGS. 1 and 2. It will, therefore, be appreciated that a plurality of cells 66 are defined within the loops of the second insulative component of the fabric while another plurality of cells 68 are formed in the first insulative component between adjacent vanes 34 and the front 32 and rear 30 sheets of material.

Figure 6:
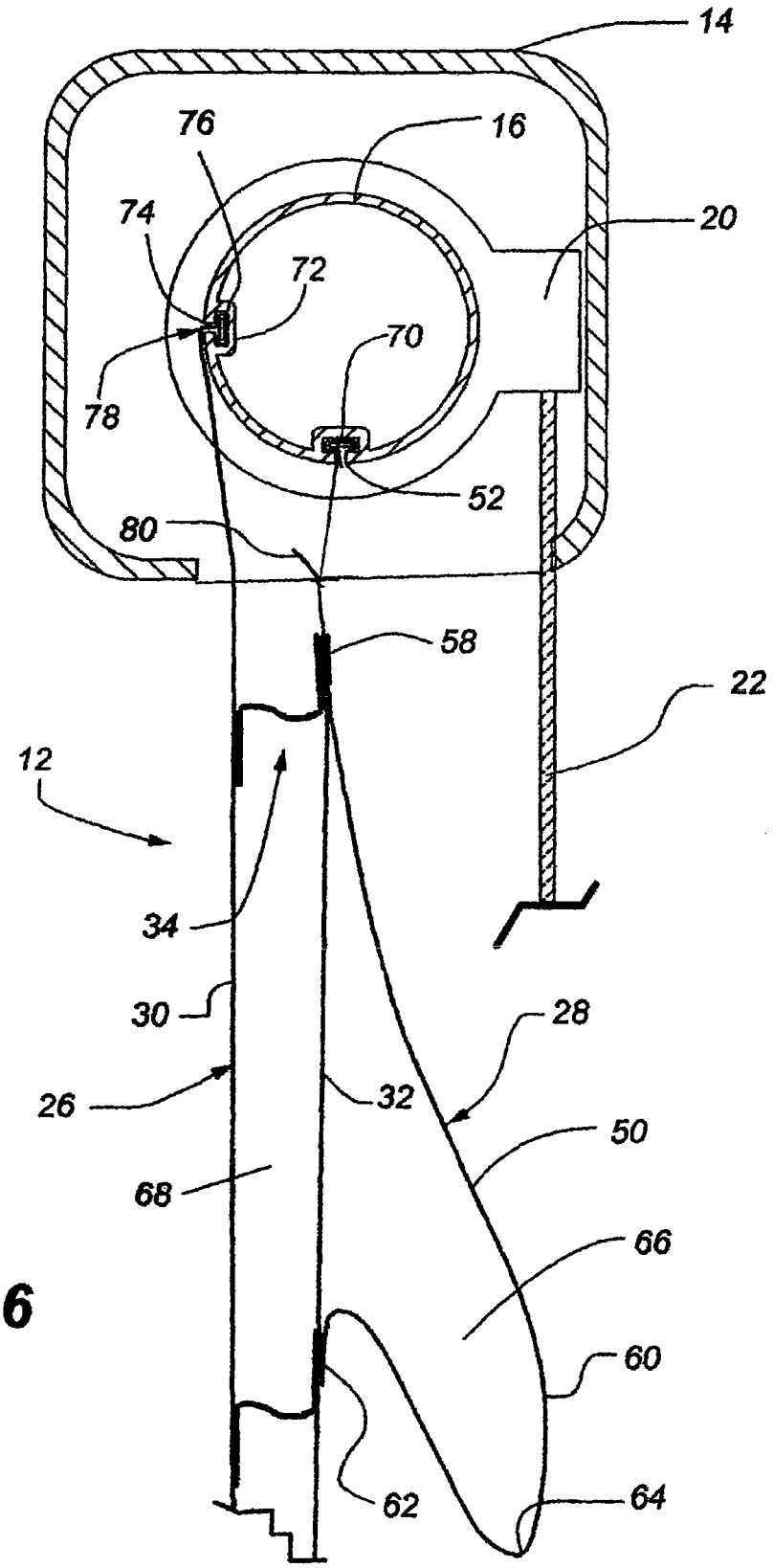
FIG. 6 is an enlarged fragmentary section taken through an upper portion of the covering of FIG. 1 with the covering in a fully-extended position and with the first cellular component extended.
Figure 7:
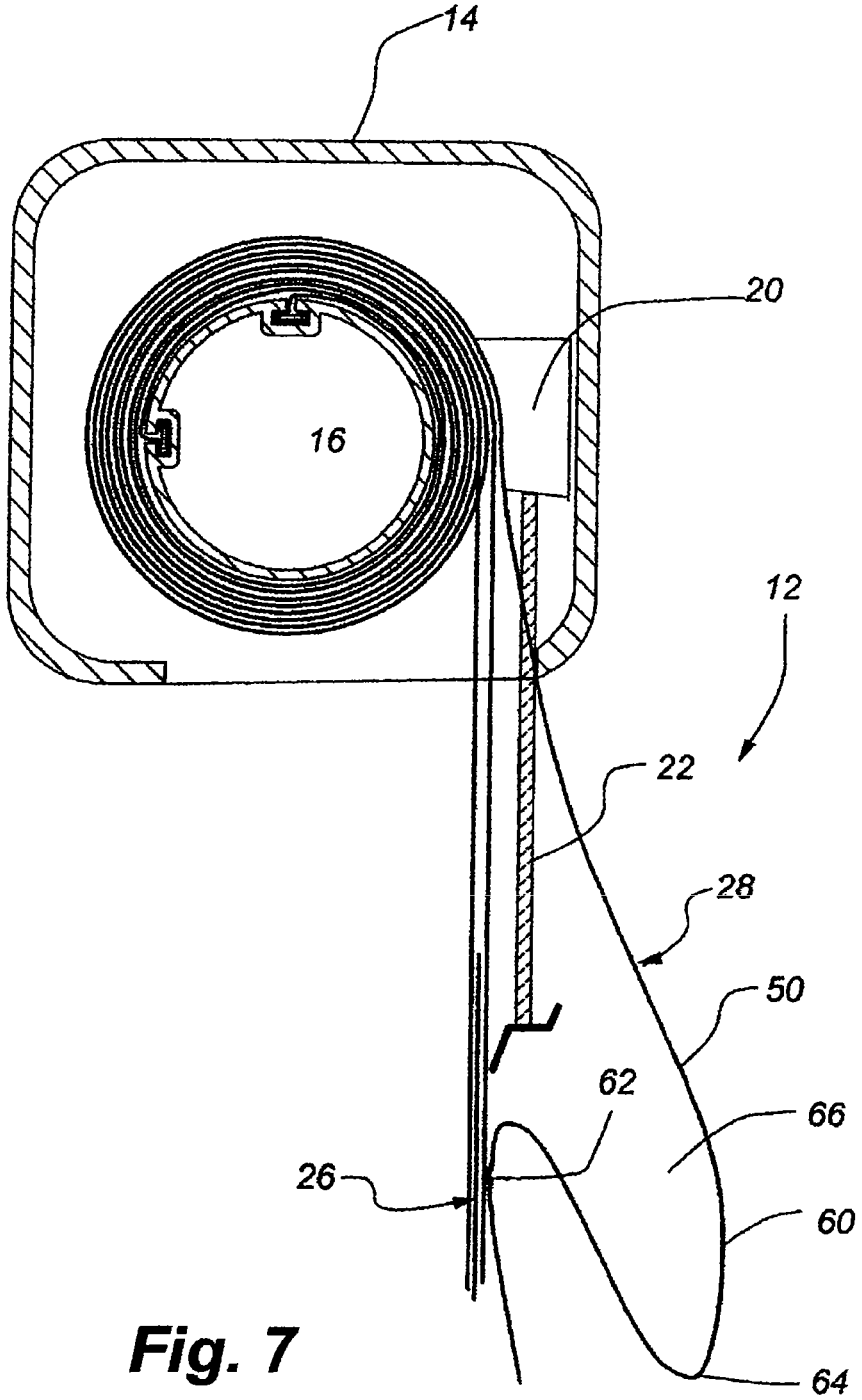
FIG. 7 is a section similar to FIG. 6 with the covering partially retracted onto the roller in the headrail and showing the first component collapsed.

The fabric 18 is suspended from the roller 16 in the headrail 14 in any suitable manner but by way of illustration in FIG. 6, the roller has a pair of outwardly opening channels 70 and 72 that are spaced 90 degrees apart with one channel 70 being at the bottom of the roller and the other channel 72 along a rear edge of the roller when the fabric is fully extended and expanded. The top edge 74 of the rear sheet 30 of the first insulative component 26 of fabric has a hem formed therein and is inserted into the rear channel 72 of the roller and held in the rear channel with an anchor strip 76, which is of greater dimension than a neck or narrow slot 78 forming an opening or entrance into the channel from the outer surface of the roller. Similarly, the top edge 52 of the sheet of material 50 forming the second insulative component 28 is secured in the lowermost or bottom channel 70 of the roller while a top edge 80 of the front sheet 32 of the first insulative component of the fabric is severed as seen best, for example, in FIG. 6 but could be secured in bottom channel 70 with material 50.

Figure 2:
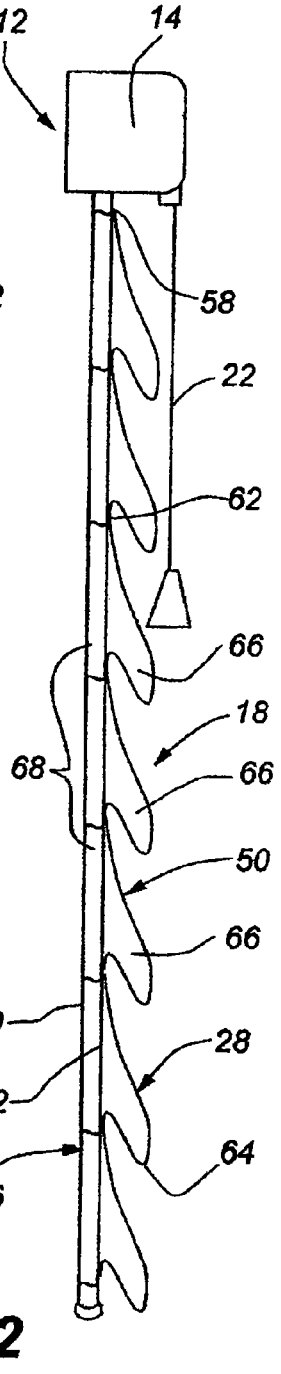
FIG. 2 is a left side elevation of the covering as shown in FIG. 1.
Figure 3:
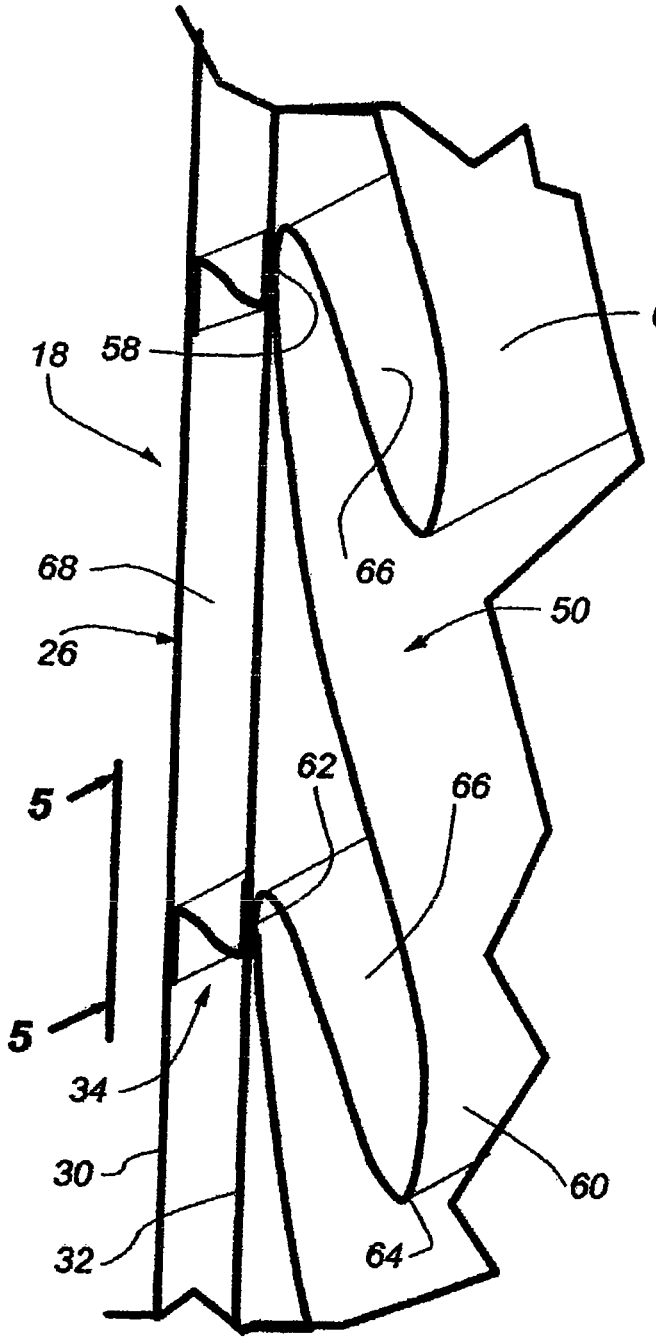
FIG. 3 is an enlarged fragmentary section taken along line 3-3 of FIG. 1.
Figure 4:
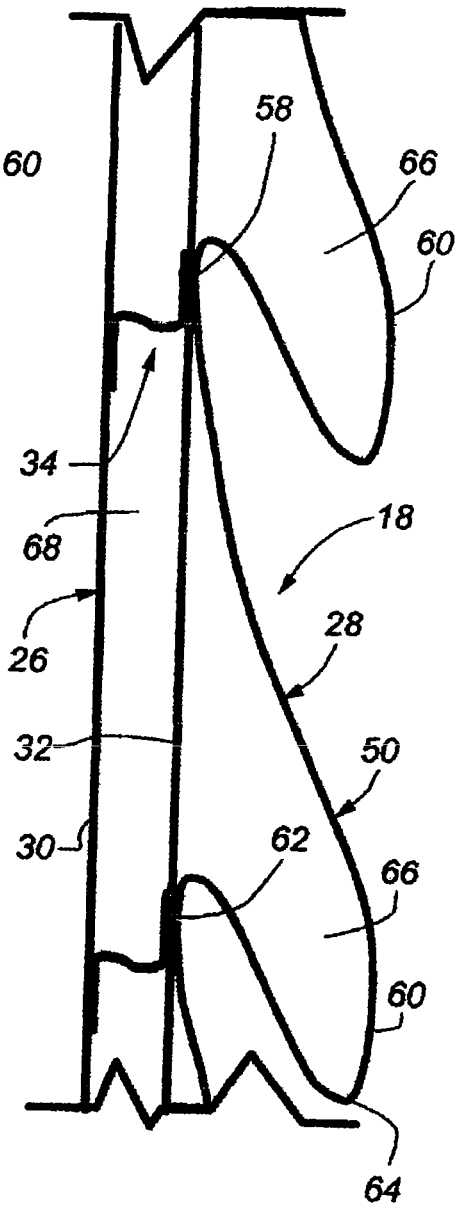
FIG. 4 is a left side elevation of the covering as shown in FIG. 3.

When the pull cord 22 is pulled downwardly to initiate a retraction of the covering from the fully-extended position of FIGS. 1 and 2 toward a fully-retracted position (not shown), the roller 16 rotates in a counterclockwise direction. Accordingly, the first 180 degrees of rotation will cause the channel 70 on the bottom of the roller to shift to the top of the roller (in the position of FIG. 7), and the channel 72 on the rear of the roller to move to the front of the roller so that the first insulative component 26 of the fabric 18 hangs downwardly from the front edge of the roller and in a collapsed position of the fabric with the front 32 and rear 30 sheets of material in the first insulative component of the fabric being closely adjacent to each other and the vanes 34 in a flat condition therebetween. Further counterclockwise rotation of the roller by pulling downwardly on the pull cord causes the roller to continue to rotate in a counterclockwise direction so that the fabric wraps therearound as shown in FIG. 7. When the bottom rail 24 of the fabric moves to the bottom of the headrail 14, the covering is fully retracted and the brake in the control system can be activated to hold it into this retracted position. As mentioned previously, to again extend the covering, the brake is released with the pull cord so that the weight of the bottom rail causes the fabric to unwind from the roller causing the roller to rotate in a clockwise direction until a desired amount of extension has been obtained. If this desired amount is less than fully extended, the brake can be activated with the pull cord to retain the covering in a partially extended position.

When the fabric 18 is wrapped around the roller 16, the sheet 50 of material in the second insulative component 28 collapses but has some resiliency so when the fabric is unwound from the roller the drooped cells 66 will again expand.

Figure 8:
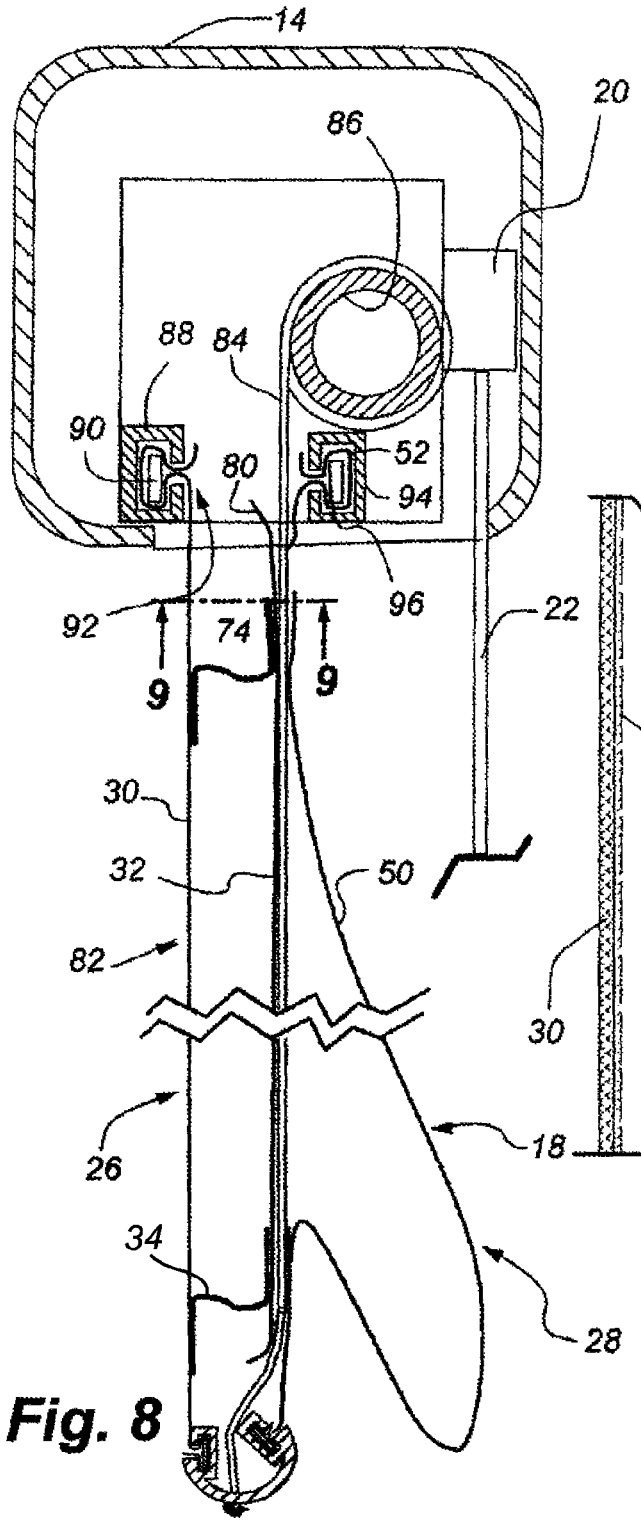
FIG. 8 is a vertical section of an upper portion of a second embodiment of the covering in accordance with the present invention with the covering fully extended.
Figure 9:
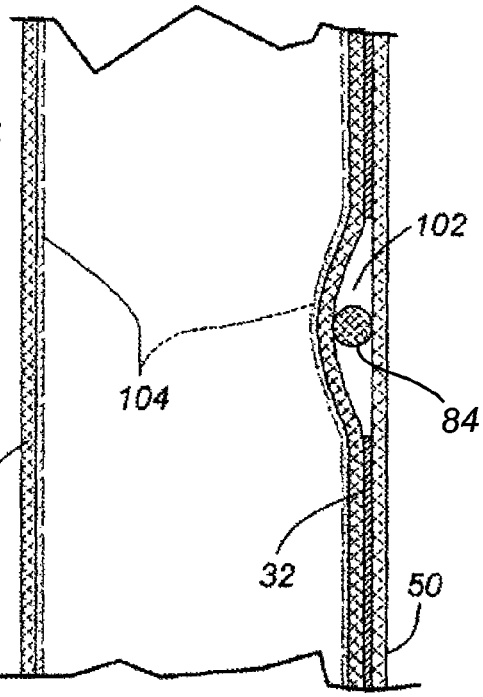
FIG. 9 is an enlarged horizontal fragmentary section taken along line 9-9 of FIG. 8.
Figure 10:
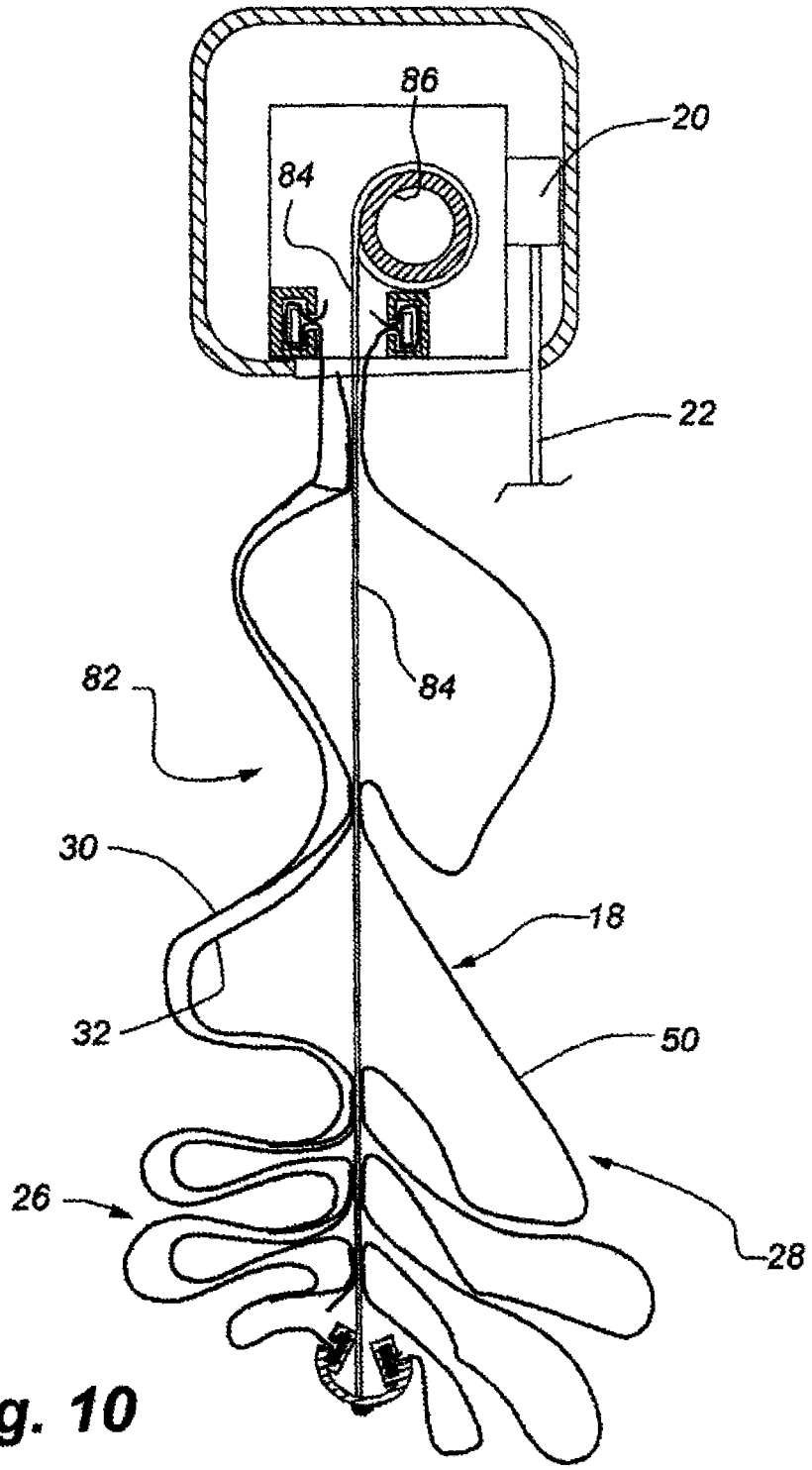
FIG. 10 is a side elevation of the embodiment of the covering shown in FIG. 8 with the fabric partially retracted.

A second embodiment 82 of the covering is shown in FIGS. 8-10. In this embodiment, the fabric 18 is formed identically to that of the first-described embodiment except the fabric is not attached to a roller so as to be wrapped therearound and unwrapped therefrom, but rather is lifted with lift cords 84 so as to be gathered adjacent to the bottom of the headrail 14 when fully retracted.

With reference to FIG. 8, it will be seen that a roller 86 is provided in the headrail 14 that can be operated with a control system 20 identically to that of the first-described embodiment except that the roller is not attached to the fabric but rather to the plurality of horizontally spaced lift cords 84 whose lower ends are secured to the bottom rail 24. The upper ends are secured to the roller 86 and the roller is again rotated through downward pulling motions on the pull cord 22. As illustrated, a pulling motion on the pull cord will cause the roller to rotate in a clockwise direction to wrap the lift cords therearound thereby shortening their effective length and elevating the bottom rail to which the lower ends are attached. Of course, as the lower ends of the lift cords are elevated with the bottom rail, the fabric 18 is gathered as shown, for example, in FIG. 10. As with the control system described previously, the brake in the control system can be used to retain the fabric at any position between fully retracted and fully extended.

Referring to FIG. 8, the top edge 74 of the rear sheet 30 of material in the first insulative component 26 of the fabric is anchored in a rear channel 88 formed within the headrail again with an anchor strip 90 that is larger in dimension than an elongated neck or entrance 92 through which the rear fabric material is inserted into the channel. Similarly, the sheet of material 50 in the second insulative component 28 of the fabric has its top edge 52 anchored in a front channel 94 formed within the headrail in an identical manner with a second anchor bar 96. Again, the top edge 80 of the front sheet 32 of the first insulative component of the fabric has been severed but could be anchored with the sheet 50 in the front channel 94.

In this embodiment of the invention, the first insulative component 26 of the fabric 18 is never collapsed as in the first embodiment, but is rather gathered upwardly in an expanded condition as seen best, for example, in FIG. 10 as the bottom rail 24 is elevated. As can also be seen in FIG. 10, the rear sheet 30 of material in the first insulative component and the sheet of material 50 in the second insulative component of the fabric are secured to the bottom rail in channels 98 with anchor bars 100 as in the headrail.

Referring to FIG. 9, it can be appreciated the sheet of material 50 in the second insulative component 28 of the fabric is secured to the front sheet 32 of material in the first insulative component 26 of the fabric along horizontal lines of attachment 58 and 62, but there are gaps 102 in those lines of attachment to define unsecured vertically extending passages between the sheet of material 50 in the second insulative component and the front sheet of material 32 in the first insulative component through which the lift cords 84 slidably pass when extending from the roller to the bottom rail 24.

Figure 18:
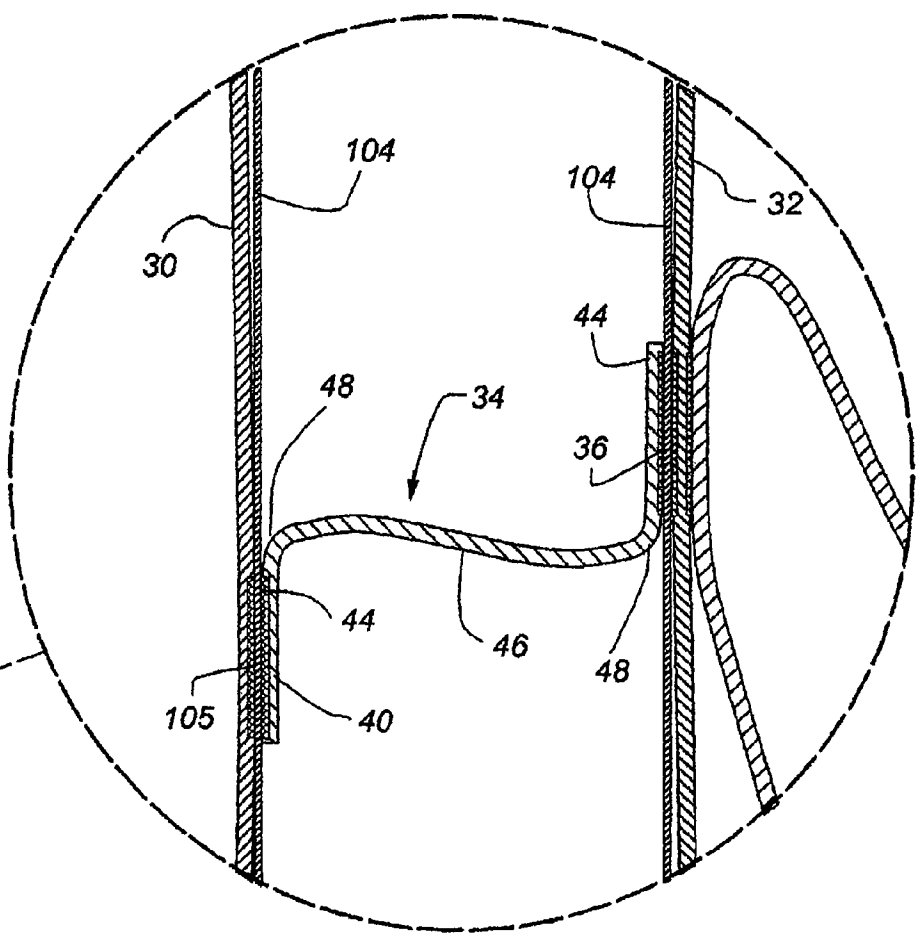
FIG. 18 is an enlarged vertical section taken in the area circled in dashed lines in FIG. 17.
Figure 17:
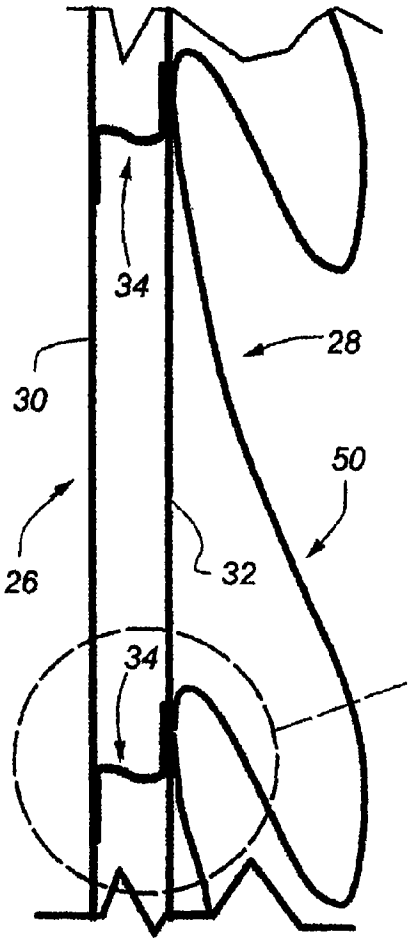
FIG. 17 is a fragmentary side elevation of the embodiment shown, for example and similarly, in FIG. 4 except with the addition of metalized coatings to improve the insulative properties.

As also appreciated by reference to FIGS. 9, 17 and 18, a flexible metal film 104 can be adhered or otherwise established on one or both (as illustrated) the confronting inner faces of the front 32 and rear 30 sheets of the first insulative component 26 of the fabric 18 which can provide an hermetic and light barrier within the first component of the fabric to enhance the insulating properties of the fabric. The metal coating can be of aluminized polyester or any other suitable metal than can be attached or established in thin layers to the front and rear sheets of material. It is preferable if the attachment is aligned with the attachment of the vanes to the front and rear sheets, as with adhesive 105 and only at these locations as the fabric can be rolled or gathered more acceptably if it is free from the front and rear sheets except along spaced lines of attachment.

The material for the front 32 and rear 30 sheets in the first insulative component 26 of the fabric and the sheet of material 50 in the second insulative component 28 of the fabric can be any suitable material having desired aesthetics. Attention should also be paid to its air permeability, which affects the insulating properties but if the metal film shown in FIG. 9 is utilized on the confronting faces of the front and rear sheets in the first insulative component, the air permeability of the material is not as important. Examples of material for use in the first insulative component would be sheers, wovens, non-wovens, laminated metalized films or fabrics. Examples for a material for use in the second insulative component would be the same.

It should also be appreciated that the sheet of material 50 in the second insulative component of the fabric does not have to be one continuous sheet but could be a plurality of horizontal strips having their upper and lower edges secured to the outer 54 face of the front sheet 32 of material.

The size of the cell 68 in the first insulative component 26 of the fabric 18 defined between adjacent vanes 34 and the front 32 and rear 30 sheets of material has been found to have an important role in optimizing the insulating properties of the covering. While the height of a cell or distance between adjacent vanes could vary widely, a cell height in the range of 3.5 to 4.5 inches and preferably substantially four inches has been found functional. The cell width, however, i.e. the width of the intermediate section 46 of each vane that defines the maximum spacing between the front and rear sheets of material has been found to be very important with a width desirably in the range of ⅜" to ¾" and preferably substantially ⅜ of an inch has been found most functional.

While a fabric material 18 formed in accordance with the first insulative component 26 might typically have an insulating R-value of between 1 and 3 and a fabric formed in accordance with the second insulative component 28 an R-value of 1 to 2, the dual or double insulating fabric 18 in accordance with the present invention, has been found to have an R-value in the range of 2 to 5, which is a significant improvement over most coverings for architectural openings. Further, a metal coating on both the front 32 and rear 30 sheets has been found to increase the R-value of the fabric relative to one without the metal coating to a value of 1 to 2 points higher.

It should also be noted that to improve the insulative properties of the fabric, additional layers could be incorporated such as by way of example two or more layers identical or substantially similar to the first insulative component 26 could be positioned in contiguous or closely adjacent relationship with each other. Alternatively, the second insulative component could be omitted even though this would adversely affect the insulative properties of the fabric.

Figure 11:
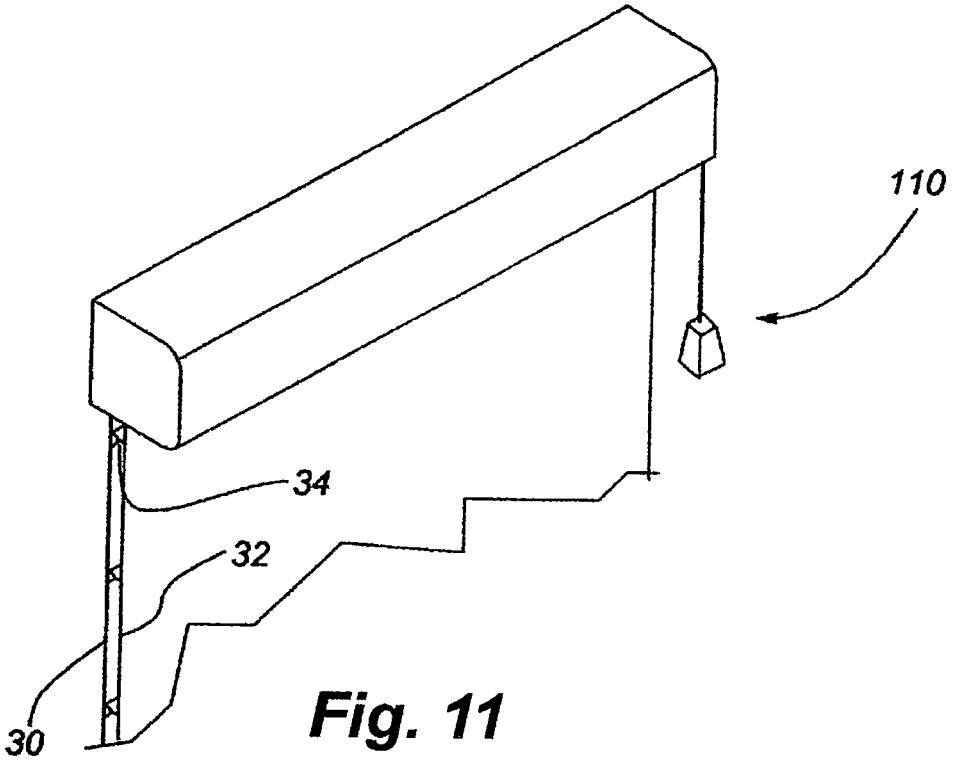
FIG. 11 is a fragmentary isometric of a third embodiment.
Figure 12:
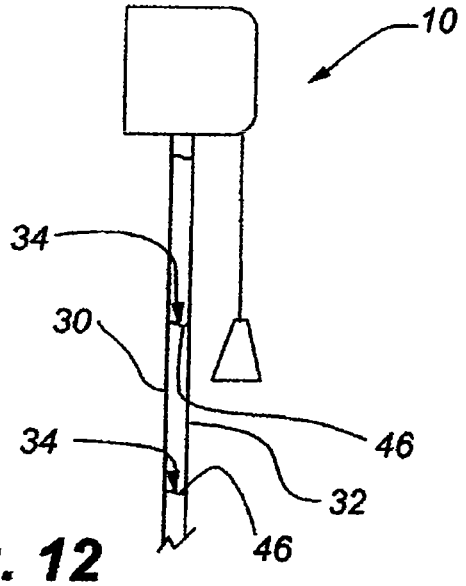
FIG. 12 is a fragmentary side elevation of the embodiments of FIG. 11.

Examples of alternative embodiments are shown in FIGS. 11-16 with FIGS. 11 and 12 showing a covering 110 containing only the first component 26 of the first-described embodiment of the present invention. In other words, the covering shown in FIGS. 11 and 12 includes a rear sheet 30 and a front sheet 32 of flexible material, which might be made, for example, of the materials identified for the first two embodiments with the two sheets being interconnected with a plurality of horizontally extending and vertically spaced vanes 34. As in the first-described embodiment, the vanes are made of a flexible material and have an upper section 36 secured in face-to-face relationship with an inner face 38 of the front sheet and a lower section 40 secured in face-to-face relationship with an inner face 42 of the rear sheet at a level beneath the connection of the vanes to the front sheet. The vanes, therefore, have an intermediate section 46 that defines the maximum spacing between the front and rear sheets, which as mentioned previously is important to the insulative properties of the covering.

The covering of FIGS. 11 and 12 could be rolled up similarly to the embodiment of FIGS. 1-7 or could be drawn and gathered upwardly similarly to the embodiment of FIGS. 8-10.

Figure 13:
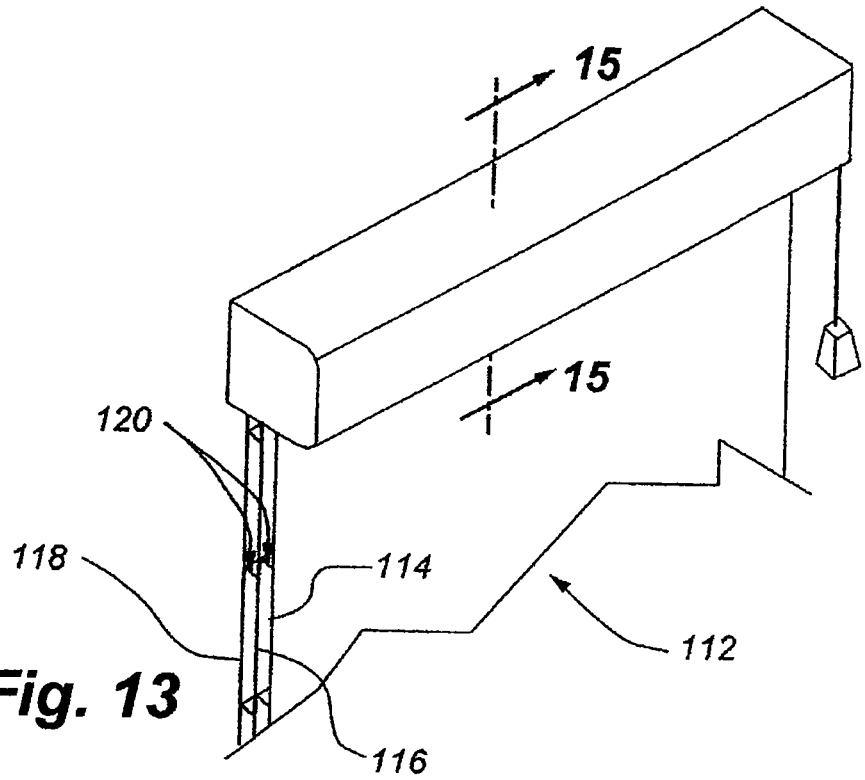
FIG. 13 is a fragmentary isometric of a fourth embodiment.
Figure 14:
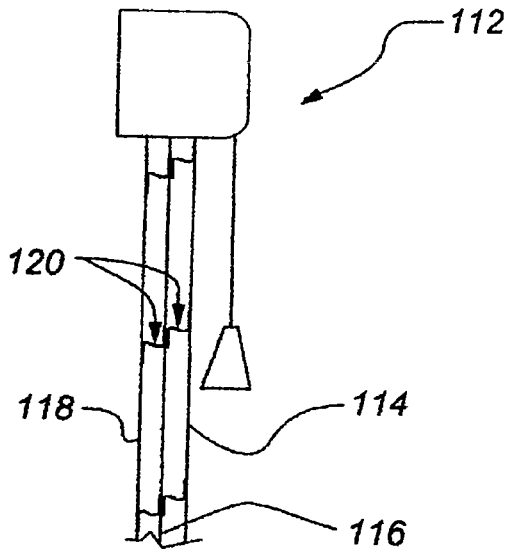
FIG. 14 is a fragmentary side elevation of the embodiment of FIG. 13.
Figure 15:
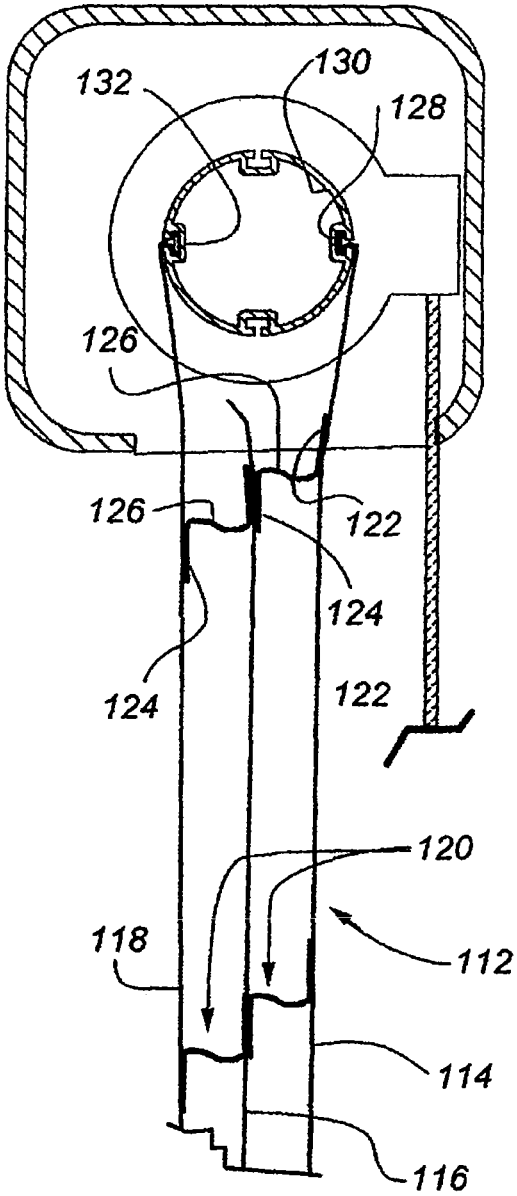
FIG. 15 is an enlarged fragmentary side elevation of the embodiment of FIG. 11 in an extended position.

Another alternative embodiment 112 of the invention is shown in FIGS. 13-16 where there are back-to-back cellular coverings of the type shown in FIGS. 11 and 12. In this embodiment, there is a front sheet 114, a middle or intermediate sheet 116, and a rear sheet 118 with the front and middle sheet being separated by horizontally extending and vertically spaced vanes 120 as in the embodiment of FIGS. 11 and 12 and with the intermediate sheet and the rear sheet also being interconnected by horizontally extending vertically spaced vanes 120. As best seen in FIG. 15, the vanes between the front sheet and intermediate sheet have an upper section 122 secured to the inner face of the front sheet 114, a lower section 124 secured to the intermediate sheet 116 with an intermediate portion 126 of the vane extending therebetween. The vanes connecting the intermediate sheet with the rear sheet have their upper sections 122 aligned with the lower sections 124 of the vanes separating the front and intermediate sheets with the lower section 124 of the vanes separating the intermediate and rear sheets being positioned downwardly therefrom so that the intermediate section 116 of both sets of vanes are horizontally disposed and vertically spaced when the front, intermediate, and rear sheets are maximally spaced as shown in FIG. 15.

Figure 16:
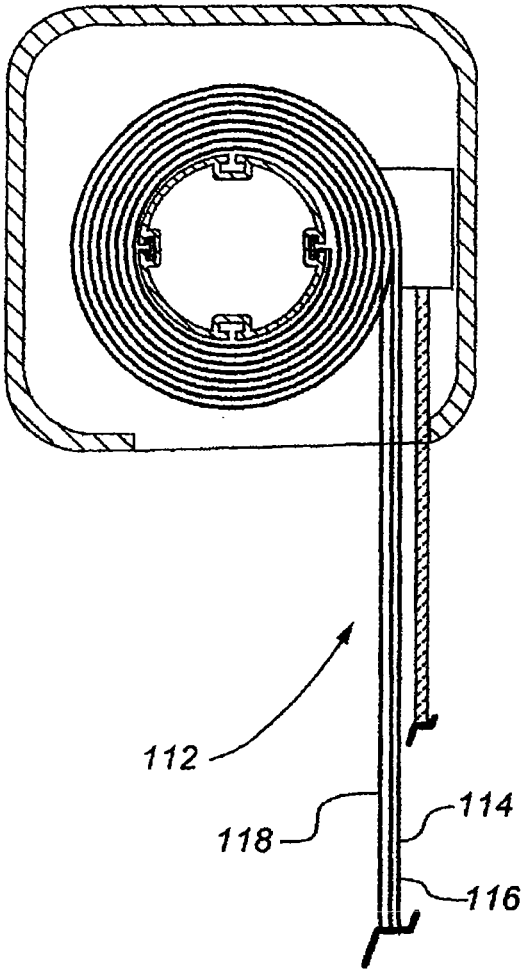
FIG. 16 is a side section similar to FIG. 15 in a partially retracted position.

While the last two described embodiments of the invention could be gathered and drawn upwardly similar to the embodiment shown in FIGS. 8-10, the embodiment of FIGS. 13-16 is illustrated as being a roll-up covering (which would be identical for the embodiments of FIGS. 11 and 12) with the front sheet 114 being secured, when the covering is fully extended, in a forwardly opening channel 128 in a roll bar 130 and the rear sheet 118 being secured in a diametrically opposed rearwardly opening channel 132 in the roll bar. The intermediate sheet 116 is severed at the top and is, therefore, not connected to the roll bar. Rotating the roll bar in a counterclockwise direction as shown in FIGS. 15 and 16 causes the sheets to initially be moved into closely adjacent parallel relationship through the first 180° rotation of the roller and continued rotation causes both sheets to wrap about the roller. Of course, rotation of the roller in the opposite clockwise direction allows it to unroll from the roller with the final 180° or half rotation of the roller separating the front, intermediate, and rear sheets so they hang from the roller as shown in FIG. 15.

Figure 19:
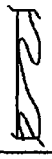
FIG. 19 is a table illustrating the various insulative properties of the embodiments of the invention illustrated and wherein the coverings are made from identified types of material.
Figure 19:
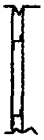
Figure 19:
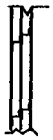
Figure 19:
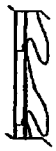

Referring to FIG. 19, a table illustrating the insulating properties of the embodiments of the invention described previously is presented by referencing the R-values of the coverings depending upon the type of material from which they are made. As was mentioned previously, the material from which the various embodiments are made include knits, wovens, as well as the use of metalized film and for purposes of better describing the insulative properties of the coverings described, the insulative properties are described by covering type and whether or not the materials used are a knit material which has high air permeability, a woven material which has low air permeability, and/or metalized film which has no air permeability.

As will be appreciated, the table references a first type of covering which is identified as simply the looped face fabric referred to previously as the second confronting cellular insulative component 28 of the first-described embodiment 18 of the invention. Remembering that the looped-face fabric can be made in a knit or woven material, as well as others, and could be coated with a metalized film, it will be appreciated that the covering of the looped-face fabric type made of a knit material would have an R-value of 1. It would, therefore, add to the insulative property of a glass panel in an architectural opening, which would have an R-value of, for example 3.5, an additional R-value of 1. In other words, by positioning a looped-face fabric, of the type described previously as the second insulative component 28 of the covering 18, adjacent to a glass pane, when the looped-face fabric material is knit, an overall R-value of 4.5 would be achieved. If the looped-face fabric were made of a woven material, the R-value would be increased by 2 over the value of the glass pane itself, or would have a total R-value of 5.5. Adding metalized film to either the knit or the woven material or using it alone would also increase the R-value by 2 over that of the glass window pane itself of 3.5.

The second type of material referenced in the table of FIG. 19, is a single-cell structure of the type shown in FIGS. 11 and 12 and this structure can be seen in the table to increase the R-value of a glass pane by 1 if the materials used in the coverings are knit, or by 2 if the materials are woven. If metalized film is utilized with each sheet over either a knit or a woven, the R-value of the glass pane itself is increased by 3 for a total of 6.5.

Referencing the double-cell structure of a covering as illustrated in FIGS. 13 and 14, it will be appreciated that if this structure were made of a knit material, it would add 1.5 to the R-value of the glass pane in a window or would add 3 to the R-value if the materials were woven. If metalized film were added to either the knit or woven materials in this embodiment, the R-value of the glass pane would be increased by 5, which assumes that each layer of the covering had a coating of metalized film as shown, for example, in FIG. 18 even though there is only one insulative component rather than two illustrated.

The final type of covering referenced in the table is the covering of FIGS. 1 and 2 and it will be appreciated that if the material used in this covering were knit, it would increase the R-value of the glass pane by 1.5 so that a total R-value of 5 would be achieved. If the material used in the covering were woven, the covering would increase the R-value by 2.5 and if each layer of material in the covering also included a metalized film coating, then the R-value would be increased by 3.5 to a total of 7.0 including the glass pane.

A further embodiment 140 of the covering of the present invention is shown in FIGS. 20-31 with the covering being very similar to the embodiment of FIGS. 1-7 except where the front sheet 32 of the first cellular insulative component of the covering is no longer a continuous sheet of material but an assembly of interconnected horizontal strips of material 142 to which vanes 144 are connected to form a structural component 146 of the covering. Accordingly, the first cellular insulating component 148 of the covering has a rear sheet of material 150, which may be sheer fabric, for example, and preferably having transparent characteristics to which is attached a plurality of vertically aligned and overlapping structural components 146 of the type shown for example in FIGS. 23 and 24. Once the structural components are interconnected to the rear sheet, as will be described hereafter, the first insulative component of the covering is completed.

Figure 22:
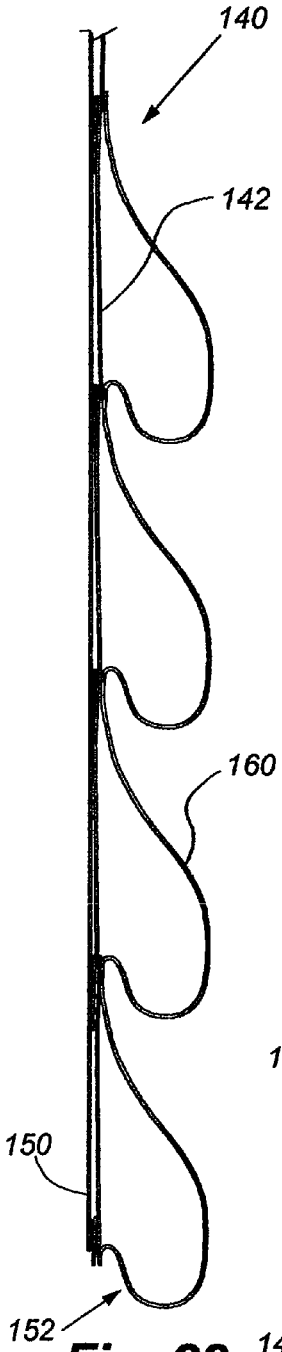
FIG. 22 is a side elevation of the covering as shown in FIG. 21 in a partially collapsed position.
Figure 21:
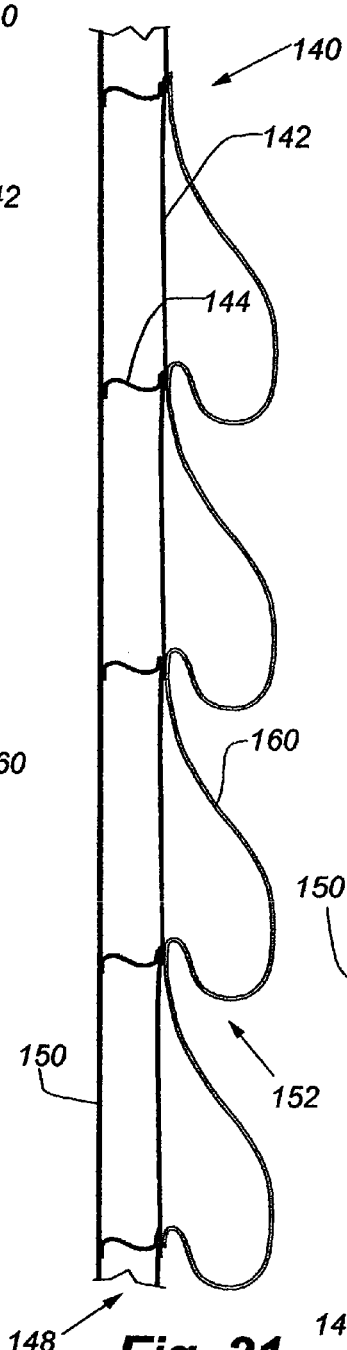
FIG. 21 is a side elevation of the covering shown in FIG. 20.
Figure 20:
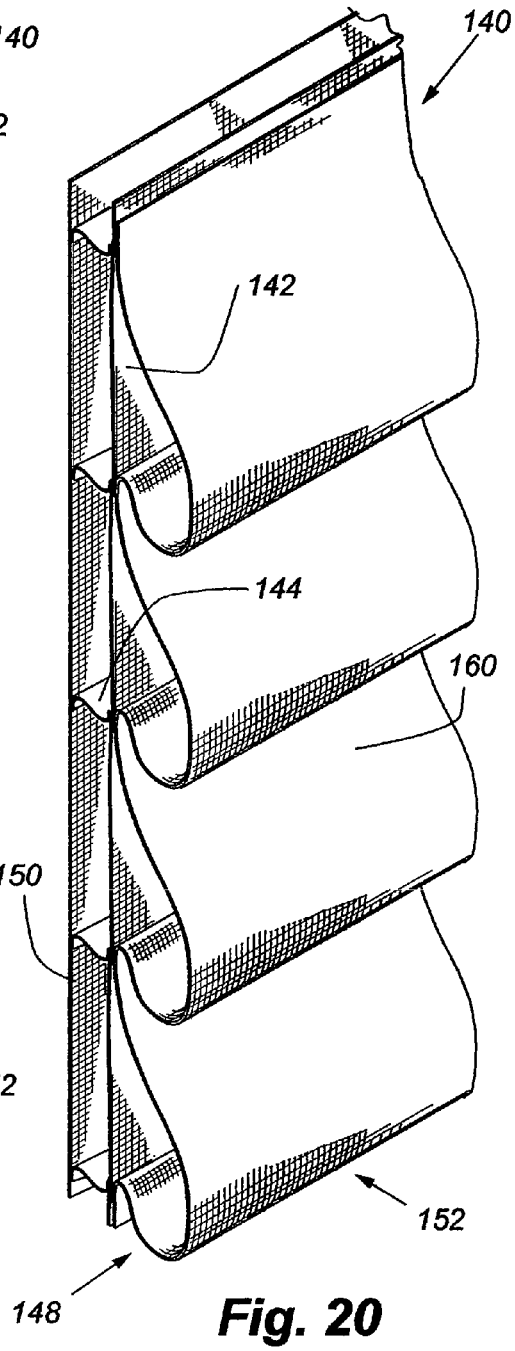
FIG. 20 is an isometric of a still further embodiment of the covering of the present invention.
Figures 23, 24:
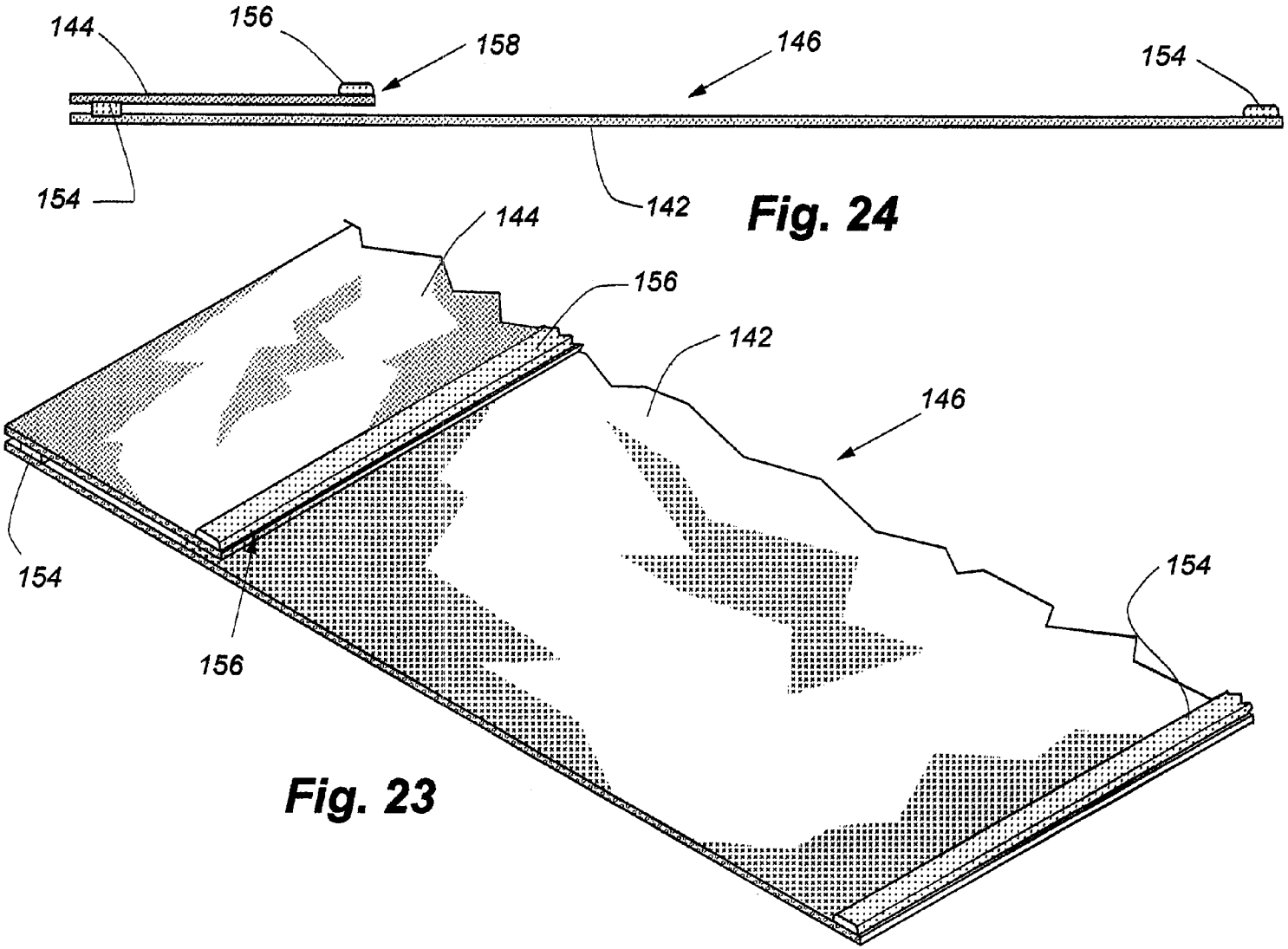
FIG. 23 is an isometric of a structural component used in the embodiment of the invention shown in FIG. 20.
FIG. 24 is a side elevation of the component shown in FIG. 23.

The second insulative component 152 of the covering again is a drooping fabric such as shown as fabric 18 in the embodiment of FIGS. 1-7 so that in combination the fabric for the covering is of a type shown in FIGS. 20-22, for example, wherein the first and second cellular insulative components 148 and 152, respectively, of the covering are interconnected so that the product has a front component, i.e. the second cellular insulative component 152 having a Roman shade appearance which faces inwardly into a room and a back-up or rear cellular component 148, which enhances the insulative properties of the covering.

The first cellular insulative component 148, as mentioned above, is formed from a plurality of structural components 146 which are connected in vertically adjacent overlapping relationship to the back sheet 150, which is a continuous sheet of material preferably transparent and could, for example, be a sheer fabric. The structural component, by reference to FIGS. 23 and 24, includes a horizontal strip of material 142 that could be any one of many different suitable materials but preferably having translucent characteristics and having a length which extends horizontally that is greater than its width and with the machine direction of the material extending horizontally. As is known in the textile industry, fabrics are stiffer in their machine direction and, of course, relatively more flexible in a cross direction with the cross direction being vertically oriented in the present invention. The strip of material 142 is provided with a horizontal adhesive line 154 on its top surface adjacent each longitudinal edge as viewed in FIGS. 23 and 24 with a vane 144 secured to the strip of material on its underside via the adhesive line 154 along the left upper edge of the strip material. The connection could also be through ultrasonic bonding or other suitable means of connection. The vane is of corresponding length to the strip material 142 but has a width which is substantially less, for example one-fourth of the width of the strip material. The vane can be provided with a line of adhesive 156 along its top surface at its free edge 158.

Figure 25:
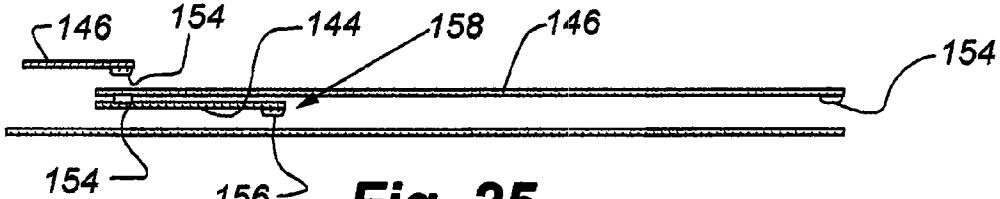
FIG. 25 is a diagrammatic illustration showing the assembly of the structural component of FIG. 23 with other components and with a sheet of material used in the covering of FIG. 20.
Figure 26:
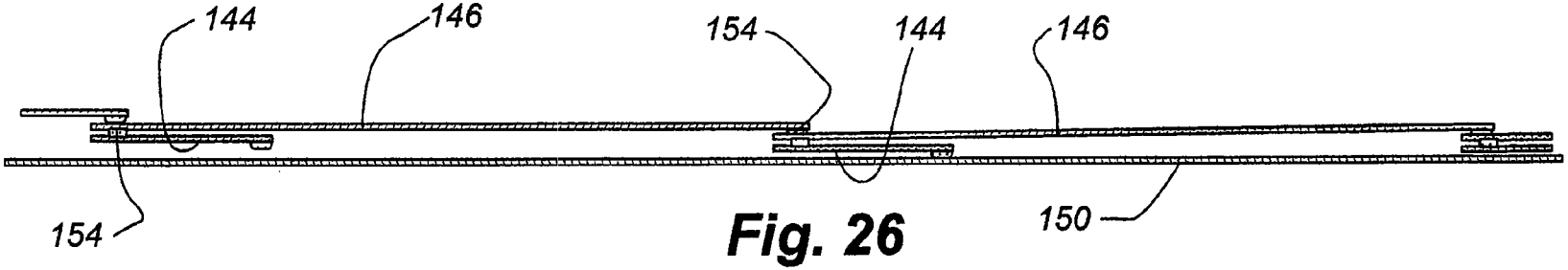
FIG. 26 is an enlarged elevation similar to FIG. 25 showing additional structural components.
Figure 27:
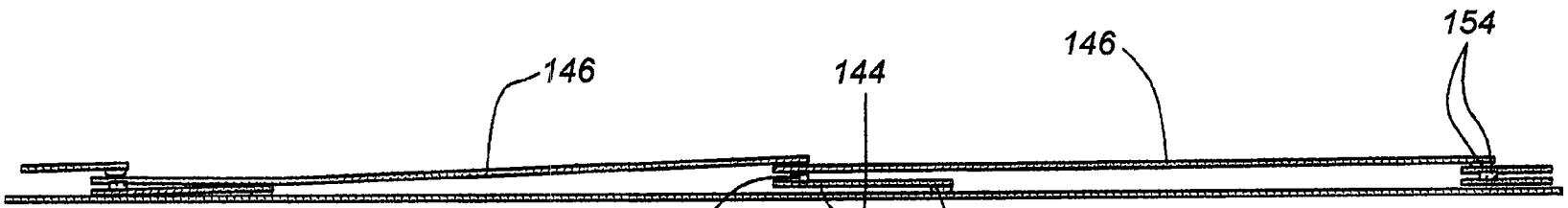
FIG. 27 shows two structural components being joined to the sheet of material of FIG. 26.

With reference to FIGS. 25-27, the structural components 146 are illustrated being connected to the back sheet of material 150, again with each structural component having a strip 142 and a vane 144 which have been interconnected. Looking first at FIG. 25, the structural component is shown inverted relative to its orientation in FIG. 24 so that the line of adhesive 156 on the free edge of the vane is in confronting relationship with the underlying back sheet of the first cellular insulative component 148. The free edge 158 of the vane is therefore securable to the underlying back sheet either with the line of adhesive 156 illustrated or with ultrasonic bonding or any other suitable method. The line of adhesive 154 on the top of the strip of material 142 opposite its edge having the vane connected thereto is shown in its inverted state in confronting relationship to the back sheet, but rather than being connected to the back sheet, it is connected to the next adjacent structural component as seen best for example in FIG. 26. In other words, the structural components are connected to the back sheet by connecting the free edge of a vane to the back sheet but with each strip of material being connected to the next adjacent strip of material at an overlap location either through adhesive bonding, ultrasonics, or the like. In FIG. 27, the securement of a structural component to the backing sheet at the left edge of the view is shown during a compressive procedure while the connections to the right thereof have already been completed.

Figure 28:
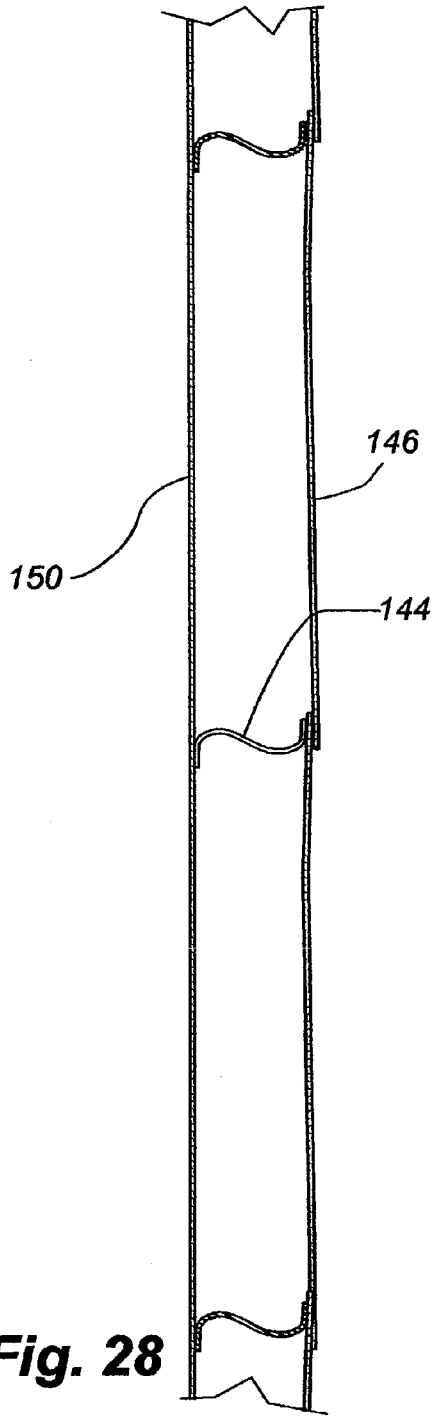
FIG. 28 is a vertical side elevation of one insulative component of the covering of FIG. 20 in an expanded condition.
Figure 29:
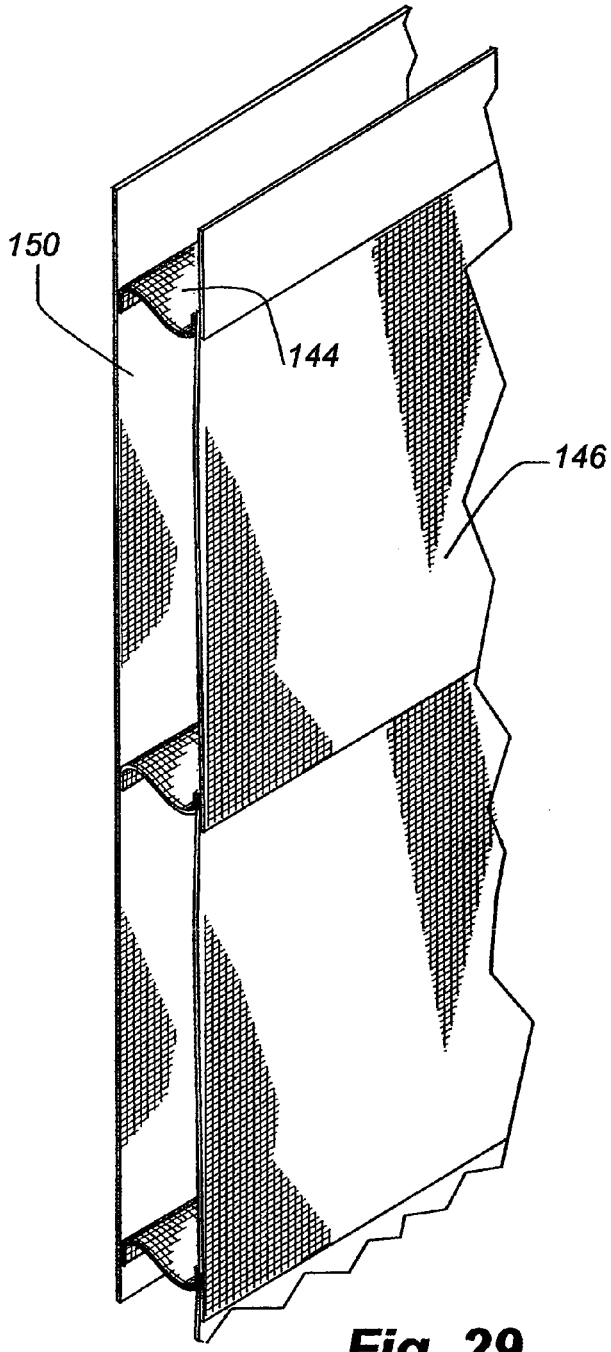
FIG. 29 is an isometric of the covering as shown in FIG. 28.

Looking next at FIGS. 28 and 29, the integrated structural components 146 and backing sheet 150 can be seen to comprise the first cellular insulative component 148 of the covering with a back sheet and a plurality of strips of material 142 forming a front sheet thereof and with the vanes 144 extending therebetween to connect the segmented front sheet to the unitary back sheet with the vanes assuming a generally S-shaped cross-section. The vanes are also preferably made of a translucent material having the machine direction extending longitudinally thereof so that the vanes are more flexible in a cross direction to assume the S-shaped transverse cross-section illustrated. The strips of material and the vane material could be made of the same material or differing materials, but in the preferred embodiment, whether they are the same or different, they would be translucent so as to permit the passage of light but not vision.

Figure 30:
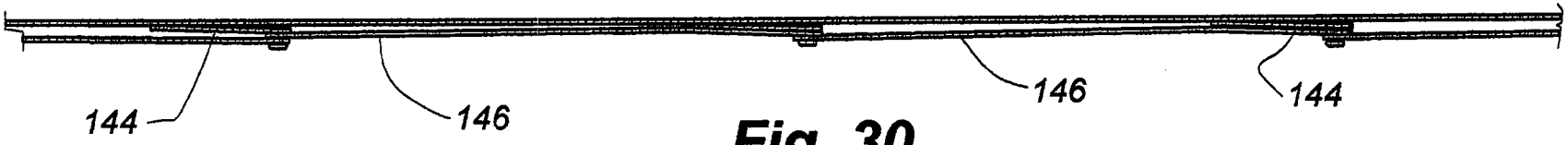
FIG. 30 is a side elevation of the fabric of FIG. 28 shown in a collapsed position with the addition of lines of adhesive for connecting the second insulative component of the covering to the first insulative component.
Figure 31:
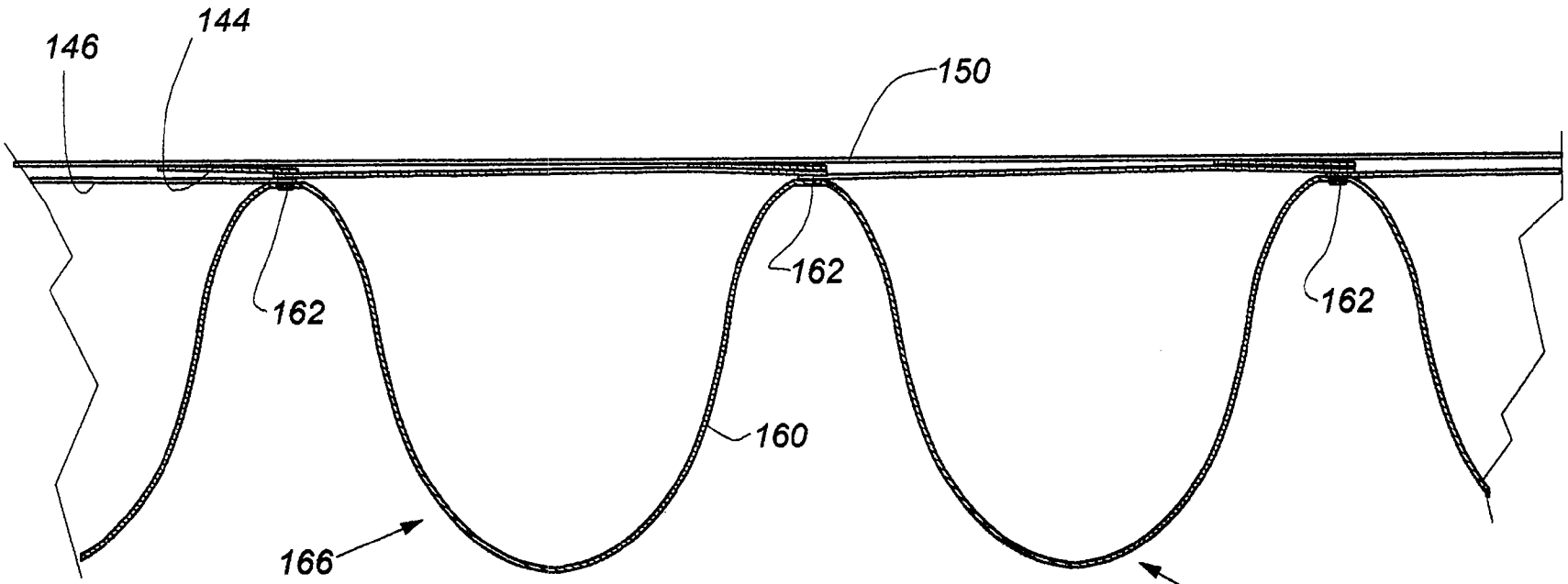
FIG. 31 is a side elevation similar to FIG. 30 with the second insulative component secured to the first insulative component.

Referring to FIGS. 30 and 31, it is shown how the second cellular component 152 of the covering 140 is attached to the first cellular component 148 with the second cellular component being the same as that in the embodiment of FIGS. 1-7, i.e. the cellular component consists of one continuous sheet of material 160 that is secured to or along vertically spaced horizontal lines of connection 162 so the sheet of material 160 forming the second cellular insulative component is formed into a plurality of loops 166 in the sheet of material which will droop as shown, for example, in FIGS. 20-22 to resemble a Roman shade. The lines of attachment between the first and second cellular components of the covering can be adhesive, ultrasonically bonded, or through any other suitable means of connection, and preferably overlie the location where structural components 146 of the first cellular insulative component are interconnected. This is not important structurally, but, for aesthetic reasons, it is preferable.

Pursuant to the above, it will be appreciated the embodiment of the covering shown in FIGS. 20-31 aesthetically resembles the covering shown in FIGS. 1-7, but the insulating properties can be enhanced by using a denser or less air permeable material to make the strips of material 142 and possibly even the vanes 144. While denser or less air permeable materials are typically stiffer which might adversely affect the desired stacking of the covering when it is retracted, if the strips of material and the vanes of material have their machine direction extending longitudinally or horizontally of the covering, the front sheet of material will be stiffer in a horizontal direction but will be relatively less stiff in its cross direction so the material will flex in the cross direction similarly to a sheet of sheer fabric, for example, as used for the front sheet 32 in the embodiment of FIGS. 1-7. Accordingly, the embodiment of FIGS. 20-31 will stack as shown in FIG. 10 illustrating stacking of the embodiment of FIGS. 1-7.

Although the present invention has been described with a certain degree of particularity, it is understood the disclosure has been made by way of example, and changes in detail or structure may be made without departing from the spirit of the invention as defined in the appended claims.

What is claimed is:

1. A covering for an architectural opening, comprising:

a headrail;

a bottom rail operably associated with said headrail and extendable from and retractable to said headrail; and a fabric operably associated with said headrail and said bottom rail, said fabric including a first cellular component and a second cellular component, said first cellular component including a pair of vertically-extending, parallel sheets interconnected at vertically-spaced locations by a plurality of horizontally-disposed vanes, each of said vanes including vertically-oriented end portions attached to said sheets, said first cellular component defining a plurality of cells between said sheets and adjacent vanes, and said second cellular component including a material attached to one of said sheets to form a plurality of droops of said material, each of said plurality of droops attached to said one of said sheets at a first location aligned with one of said vertically-oriented end portions of one of said vanes and at a second location aligned with one of said vertically-oriented end portions of another one of said vanes to define a plurality of vertically-adjacent cells horizontally disposed from said one of said sheets, wherein when the covering is in a retracted position, said sheets of said first cellular component overlap each other and substantially gather on a first side of said bottom rail, and said second cellular component substantially gathers on a second side of said bottom rail.

2. The covering of claim 1, further comprising a control system for moving said fabric between an extended position where said fabric hangs vertically from said headrail and said retracted position where said fabric is disposed adjacent to said headrail.

3. The covering of claim 1, further comprising a rotatable roller operably associated with said headrail.

4. The covering of claim 3, further comprising a lift cord operably associated with said headrail and said bottom rail, wherein when the covering is in said retracted position, said lift cord is wrapped about said roller.

5. The covering of claim 1, wherein said sheets of said first cellular component are sheer fabric.

6. The covering of claim 1, further including a metallic coating on a face of at least one of said sheets of said first cellular component.

7. The covering of claim 1, wherein one of said sheets is made of a plurality of interconnected, horizontally-extending strips.

8. The covering of claim 7, wherein said strips are a textile material having a length extending horizontally in the covering, and wherein a machine direction of said textile strips is in a longitudinal direction.

9. The covering of claim 1, wherein said vanes have a width that defines a horizontal spacing between said sheets, and wherein said horizontal spacing is less than a vertical spacing between adjacent vanes.

10. The covering of claim 1, wherein said vanes are made of a textile material having a length extending horizontally in the covering, and wherein a machine direction of said textile vanes is in a longitudinal direction.

11. The covering of claim 1, wherein said vanes are operably connected to said sheets along a vertical face of each of said sheets.

12. The covering of claim 1, wherein said another one of said vanes is a next adjacent, lower vane from said one of said vanes.

13. The covering of claim 1, wherein each of said plurality of cells of said first cellular component is substantially four inches high and ⅜ inch wide.

14. The covering of claim 1, wherein said first cellular component has an insulating R-value in a range of 1-3.

15. The covering of claim 14, wherein said second cellular component has an insulating R-value in a range of 1-2.

16. The covering of claim 1, wherein said droops of said second cellular component are formed from one continuous sheet of material.

17. The covering of claim 1, wherein said material of said second cellular component is secured to said one of said sheets in said first cellular component along vertically-spaced horizontal lines of attachment.

18. The covering of claim 17, wherein said material of said second cellular component is secured to said one of said sheets of said first cellular component with adhesive.

19. A covering for an architectural opening, comprising:

a headrail;

a rotatable roller operably coupled to said headrail;

a bottom rail;

at least one lift cord operably coupled to said roller; and a fabric structure suspended from said headrail, said fabric structure comprising:

a pair of substantially parallel sheets interconnected at vertically-spaced locations by a plurality of vanes; and a plurality of horizontally-disposed cells formed from droops of material attached to one of said sheets at a first location and a second location, wherein:

when the covering is in a retracted position, said at least one lift cord is wrapped about said roller, said sheets overlap each other and substantially gather on a first side of said bottom rail, and said plurality of cells substantially gather on a second side of said bottom rail;

said droops of material are attached to said one of said sheets along horizontal lines of attachment with gaps formed in said horizontal lines of attachment; and said at least one lift cord is slidably positioned at least partially in said gaps.

20. The covering of claim 19, wherein each of said plurality of vanes comprises a first component secured to one of said sheets, a second component secured to the other of said sheets, and an intermediate portion extending between said sheets, said intermediate portion extending in a range of ⅜ inch to ¾ inch to establish a maximum spacing in that range between said sheets.

21. The covering of claim 19, wherein each vane is vertically spaced from an adjacent vane in a range of 3.5 to 4.5 inches.

22. The covering of claim 19, further including a third sheet of vertically-extending material and a second plurality of vanes interconnecting said third sheet to one of said pair of sheets at vertically spaced locations.

23. The covering of claim 22, wherein said second plurality of vanes establish a maximum spacing in a range of ⅜ inch to ¾ inch between the sheets to which they are connected.

24. The covering of claim 23, wherein said second plurality of vanes is substantially aligned with said plurality of vanes of said pair of substantially parallel sheets.

25. The covering of claim 22, wherein said second plurality of vanes are elongated and horizontally oriented.

26. The covering of claim 19, wherein said plurality of vanes are elongated and horizontally oriented.

27. The covering of claim 19, wherein one of said sheets is made of a plurality of interconnected, horizontally-extending strips.

28. The covering of claim 27, wherein said strips are a textile material having a length extending horizontally in the covering, and wherein a machine direction of the textile strip is in a longitudinal direction.

29. The covering of claim 19, wherein said vanes are made of a textile material having a length extending horizontally in the covering, and wherein a machine direction of the textile vanes is in a longitudinal direction.

30. The covering of claim 1, wherein a distance between said adjacent vanes is greater than a maximum spacing between said sheets.

31. The covering of claim 19, wherein a distance between adjacent vanes of said plurality of vanes is greater than a maximum spacing between said sheets.

32. The covering of claim 1, wherein attachment of said second cellular component to said first cellular component causes said fabric to stack on said bottom rail.

33. The covering of claim 19, wherein said at least one lift cord is attached to said bottom rail.

34. The covering of claim 1, wherein said pair of parallel sheets is insulating and not sheer.

35. The covering of claim 19, wherein said pair of substantially parallel sheets is insulating and not sheer.

* * * * *